US006493666B2

(12) United States Patent
Wiese, Jr.

(10) Patent No.: US 6,493,666 B2
(45) **Date of Patent: *Dec. 10, 2002**

(54) SYSTEM AND METHOD FOR PROCESSING DATA FROM AND FOR MULTIPLE CHANNELS

(76) Inventor: William M. Wiese, Jr., 444 N. El Camino Real, #205, San Mateo, CA (US) 94401

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 89 days.

(21) Appl. No.: 09/357,858

(22) Filed: Jul. 21, 1999

(65) Prior Publication Data

US 2001/0027392 A1 Oct. 4, 2001

Related U.S. Application Data

(60) Provisional application No. 60/102,237, filed on Sep. 29, 1998.

(51) Int. Cl.[7] ..... G10L 19/00

(52) U.S. Cl. ..... 704/230; 704/201; 704/223; 704/500

(58) Field of Search ..... 704/230, 201, 704/208, 214, 219, 220, 224, 223, 222, 500–504

(56) References Cited

U.S. PATENT DOCUMENTS 5,165,008 A * 11/1992 Hermansky et al. ..... 704/201
5,729,694 A * 3/1998 Holzrichter et al. ..... 704/208
5,742,930 A * 4/1998 Howitt ..... 704/502

FOREIGN PATENT DOCUMENTS

WO WO 95/17745 * 6/1995 ..... G10L/3/02

* cited by examiner

*Primary Examiner*—Richemond Dorvil
*Assistant Examiner*—Vijay B Chawan
(74) *Attorney, Agent, or Firm*—Covington & Burling

(57) ABSTRACT

This invention takes advantage of the potential for a group of data channels, especially if they are carrying a related form of information such as human telephone conversations, to be compressed for transmission as a group to a greater degree than if the channels were compressed individually. A focus of the system and method of this invention is the organization of data from multiple channels, before the data are compressed for transmission, thereby taking advantage of redundant, extraneous or unnecessary information in common among the data. In a preferred embodiment, the invention organizes and processes human speech data from multiple voice-grade telephone channels into a highly compressed representation for transport by a packet switched network, and receives and processes those highly compressed representations to reconstruct, exactly or approximately, the human speech data. This embodiment thus provides for efficient bulk transport of multiple voice-grade telephone channels through a packet switched network. More generally, the present invention provides a system and method for processing data from multiple channels into alternate representations in order to facilitate efficient transmission. The invention more generally also provides a system and method for processing such alternate representations in order to reconstruct, exactly or approximately, data for transmission on multiple channels.

42 Claims, 5 Drawing Sheets

SYSTEM AND METHOD FOR PROCESSING DATA FROM AND FOR MULTIPLE CHANNELS

BACKGROUND OF THE INVENTION

This Application claims priority to Provisional Application No. 60/102,237 filed Sep. 29, 1998. The specification of No. 60/102,237 is incorporated herein by reference. This invention relates to the processing of data from and for multiple channels, and more particularly to the transformation of data from and for multiple channels into alternative representations in order to facilitate transmission.

DESCRIPTION OF THE RELEVANT ART

The ability to transmit data rapidly to virtually any place in the world has become one of the defining characteristics of the current information age. This ability comes at a cost, however, because it requires a global infrastructure for providing telecommunications services. Since the origins of the telecommunications infrastructure in local telephone networks, many successful attempts have been made to control costs by making the existing infrastructure perform more tasks and functions. Generally, these attempts have involved either increasing the ability of the existing telecommunications infrastructure to handle more data, or preprocessing raw data so that less data need be transmitted to convey the same amount of information.

Attempts to increase the data handling capabilities of the existing telecommunications infrastructure have included such techniques as the use of time and frequency division multiplexing. In time division multiplexing, multiple low speed channels are combined for transmission over a single high speed channel. In frequency division multiplexing, a large capacity channel is subdivided into a number of lower capacity channels. More recent development of these multiplexing techniques lies in modern packet switched networks, where data streams are broken into small segments that may be routed individually to take advantage of available channel capacity.

Sometimes, however, the available channel capacity between two or more locations is either physically limited or otherwise expensive. A dramatic example of this situation has involved communications between space probes and earth stations. Large quantities of scientific data, and particularly pictures, need to be transmitted from the spacecraft to earth via relatively low capacity channels. The solution to this problem has been the development of compression techniques that reduce the amount of data required to transmit the same amount or approximately the same amount of information.

Compression techniques generally operate by changing the representation of information from one set of data to another set of data. In the process of compression, extraneous or unnecessary information, including redundancies, may be eliminated. Using such techniques, many common representations, such as photographs and human speech recordings, can often be substantially compressed with relatively little loss of information.

Telephone carriers have widely used multiplexing techniques to take advantage of available channel capacity in transmitting human speech. More recently, and particularly with the advent of cellular telephones that operate in environments with limited channel capacity, carriers have also employed compression techniques to increase the transmission capacities of their telecommunications infrastructures. Commonly used compression techniques used are often lossy, i.e., some information is irretrievably lost, and result in changes to the "sound" of a speaker even though the words being uttered are still understandable.

The application of compression techniques has generally focused on individual communications paths and particularly on the endpoints of those paths. If compression results in the reduction in the amount of data that must be transmitted then it is logical to apply compression as close to the source of the data as possible. Thus, for example, pictures are typically compressed within space probes before they are transmitted, and likewise speech is typically compressed in cellular telephone handsets before it is transmitted. This trend has been particularly evident in traditional telephone system environments where, until recently, little computer capability to perform compression has been available at central offices and high capacity relay stations.

Especially in competitive telecommunications environments, there is continuing pressure to reduce costs and increase efficiency by making better use of the existing telecommunications infrastructure. In many cases, however, this infrastructure has recently changed radically, due to the use of various packet switching techniques to transport data. These changes were experienced initially by corporations using packet switched networks to transmit data in bulk, and more recently there has also been an increasing effect of use of these techniques on traditional telephone communications, as exemplified by U.S. Pat. No. 5,751,706 (describing a system and method for establishing a call telecommunications path that, in some embodiments, makes use of packet switched networks to transport telephone calls). These changes have also resulted in the concentration of computer processing capacity at locations where many individual data channels come together in high capacity packet switched networks.

SUMMARY OF THE INVENTION

Data compression techniques typically change the representation of information to remove extraneous or unnecessary information, including, for example, redundancies. Depending on the representation scheme employed, a particular data channel may contain substantial redundant extraneous or unnecessary information, and therefore be highly compressible. Similarly, a group of data channels, particularly if they are carrying related forms of information such as human telephone conversations, may contain substantial redundant extraneous or unnecessary information in common amongst the group of channels and thus be capable of being compressed as a group to a greater degree than if the channels were compressed individually. The availability of substantial computing power at locations where many individual data channels come together in high capacity packet switched networks provides an attractive environment for taking advantage of the compressability of groups of data channels.

Many compression techniques, defined in this specification as including the operations of quantization, scaling, and coding, are known in the art. The degree of compression provided by a particular technique, however, may be highly dependent on the arrangement or structure of the data to be compressed. Simply dispatching data, originating in multiple individual channels, to a compression mechanism will not, in many cases, take advantage of the redundant, extraneous or unnecessary information in common amongst the multiple channels. In contrast, the organization of data before it is compressed, which is a focus of the system and method of the present invention, enables the compression mechanism to take substantial advantage of the "in common" redundant, extraneous, or unnecessary information.

Of course, compression is not an end in itself, but merely facilitates the transmission of representations of sequences of digital data elements to another location where the sequences of digital data elements are approximately or completely reconstructed. As used in this specification, the term "compression-side" refers to the processing of that takes place from the receipt of information from communications channels to the presentation of compressed data to a transmission network for onward transmission. The term "decompression-side" refers to all of the processing that takes place from the receipt of compressed data from a transmission network to the presentation of approximately or completely reconstructed information to communications channels for onward transmission.

In a preferred embodiment, the present invention enables multiple voice-grade telephone channels, such as might be present at a telephone company central office, to be transmitted via packet-switched computer network in compressed form to a destination location where the multiple voice-grade telephone channels are approximately or exactly reconstructed for final transmission to ultimate destinations. A user of one of these voice-grade telephone channels would be at least substantially unaware that his call was transmitted via a packet switched network rather than through customary telephone company facilities.

As used in this specification, the term "channel" refers to both the data transported by a communications channel as well as the signaling information that is used to establish, control, and dis-establish the communications channel. In preferred embodiments of the present invention, communications channels may be permanent connections between two locations where little or no signaling information is required. In other preferred embodiments of the present invention, communications channels may provide temporary, switched services, for example normal consumer dial-up telephone service, that require extensive signaling.

As used in this specification, the terms "connection," "active connection," and "active channel" refer to either a permanent connection between multiple locations or to a switched connection that has been or is being established between multiple locations. The term "inactive channel" refers to an available switched channel that is not currently providing, or in the process of providing, a connection between multiple locations. This distinction is significant since the system of the present invention transports, approximately or exactly, all data carried by active channels supported by the system of the present invention, while that system does not transport any data that may be present on inactive channels. Thus, even silence (which may occur, for example, during pauses in a telephone conversation) or line noise is transported by the system of the present invention for active connections, while neither silence, line noise, or any other data would be transported for inactive channels. Note, however, that in a preferred embodiment, silence is represented as a brief code, as is known in the art, rather than by representations extending for the duration of the silence.

A human-speech telephone conversation is generally transmitted as a continuously varying analog waveform, or as a sequence of digital data elements representing that waveform. In preferred embodiments of the present invention, data transported by each of multiple channels is received as a sequence of digital data elements or is converted for reception to a sequence of digital data elements by a preprocessor, and is transmitted as sequence of digital data elements or is converted for transmission to a continuously varying analog waveform.

The reconstruction of a channel that is transporting a sequence of digital data elements requires knowledge of the values of the digital data elements ("value information"), their position in time with respect to each other ("sequence information"), and other information that relates the digital data elements to the channel. Throughout all of the compression-side processing, transmission, and decompression-side processing, it is necessary to maintain both value information and sequence information for each sequence of digital data elements that is being transported. Value information is normally maintained explicitly, as is known in the art, by placing particular data elements in various data structures during processing. Sequence information, however, may, as is known in the art, be maintained explicitly, implicitly, or as a combination of both. The term "identification information" is used in this specification to denote sequence information for particular data elements as well as other information that relates the particular data elements to a particular data channel. It must be noted that identification information may change at each processing stage to reflect the current manner in which sequence and other information is related to particular groups of data elements. A variety of techniques for maintaining identification information are known in the art.

The basic data structure processed by the system of the present invention is termed a "source-identified-frame," and, in a preferred embodiment, includes an ordered set of digital data elements. In this preferred embodiment, the ordered set of digital elements in a source-identified-frame is a subset of the entire ordered set of digital data elements being transported by a particular data channel. Such a subset of data elements is commonly referred to as a "time slice" of the data channel. Also included in this preferred embodiment is identification information that identifies the particular data channel that transported the subset of digital data elements, and that identifies the position of the subset in the entire ordered set of digital data elements. In a preferred embodiment, the number of digital data elements in a source-identified-frame is fixed. In a preferred embodiment, the system of the present invention is provided with source-identified-frames. In an alternative embodiment, the system of the present invention creates source-identified-frames by processing the data being transported by data channels in an operation termed herein as "segmenting." In preferred embodiments, segmenting is a function of the preprocessor element of the system for processing data from multiple channels of the present invention and of the segmenting step of the method of processing data from multiple channels of the present invention.

The following is a brief summary of the operation of the present invention. Detailed examples of the operation of the invention are provided below in the Detailed Description of the Preferred Embodiments.

On the compression side, source-identified-frames from multiple channels are independently transformed into transformed-source-identified-frames. A source-identified-frame may be transformed into more than one transformed-source-identified-frame. The transformed-source-identified-frames are then grouped together into one or more frame-blocks. Each frame-block is independently transformed into a transformed-frame-block. The transformed-frame-blocks are then compressed into data-streams and the data-streams are made available to a transmission network for transport to a destination for decompression side processing.

On the decompression side, the data-streams are received from a transmission network and decompressed into transformed-frame-blocks. Each transformed-frame-block is independently inverse-transformed into a frame-block. Each frame-block is broken down into its constituent transformed-source-identified-frames. Transformed-source-identified-frames are assembled together as required and are inverse-transformed into source-identified-frames. The source-identified-frames are made available to multiple channels for transport to ultimate destinations. It should be noted that, due to potential losses in the compression and decompression processes as are known in the art, the contents of a particular source-identified-frame may change somewhat as the source-identified-frame traverses the compression side and the decompression side of the system of the present invention.

An object of the invention is to provide a system and method for processing data from multiple channels to remove extraneous or unnecessary information both within individual channels and in common among the multiple channels.

A further object of the invention is to provide a system and method for processing data originally derived from multiple channels, from which extraneous or unnecessary information both within individual channels and in common among the multiple channels has been removed, to approximately or exactly reconstruct the original data.

A further object of the invention is to provide a system and method for processing human speech data from each of multiple channels into a compressed representation for transport by a packet switched network.

A further object of the invention is to provide a system and method for processing compressed representations of human speech data in order to approximately or exactly reconstruct the human speech data.

The present invention, as broadly described herein, provides a system for processing data from multiple channels including a first transformer, a classifier which is in communication with the first transformer, a second transformer which is in communication with the classifier, and a compression-side postprocessor which is in communication with the second transformer and a transmission network.

As broadly described herein, the system of the present invention for processing data from multiple channels may also include a compression-side preprocessor, in communication with the first transformer, that is an interface to a plurality of data channels.

The present invention, as broadly described herein, also provides a system for processing data for multiple channels including a decompression-side preprocessor which is in communication with a transmission network, a first-inverse transformer which is in communication with the decompression-side preprocessor, an assembler which is in communication with the first inverse-transformer, and a second inverse-transformer which is in communication with the assembler.

As broadly described herein, the system of the present invention for processing data for multiple channels may also include a decompression-side postprocessor, in communication with the second inverse-transformer, that is an interface to at least one data channel.

The present invention, as broadly described herein, also provides a method for processing data from multiple channels including the steps of receiving a plurality of source-identified-frames; transforming at least one source-identified-frame into at least one transformed-source-identified-frame; categorizing at least one transformed-source-identified-frame by domain type wherein there is at least one prespecified domain type; categorizing at least one transformed-source-identified-frame by category type wherein there is at least one prespecified category type; grouping at least one transformed-source-identified-frame into at least one frame-block, responsive to the domain type and the category type of the transformed-source-identified-frame; transforming at least one frame-block into at least one data-stream; and transmitting at least one data-stream to a transmission network.

As broadly described herein, the method of the present invention for processing data from multiple channels many also include the steps of receiving a plurality of data channels; segmenting at least one data channel into a plurality of source-identified-frames; and transmitting the plurality of source-identified-frames.

The present invention, as broadly described herein, also provides a method for processing data for multiple channels including the steps of receiving at least one data-stream from a transmission network; decompressing the data-stream into at least one transformed-frame-block; inverse-transforming the transformed-frame-block into at least one frame-block; separating the frame-block into at least one transformed-source-identified-frame; and inverse-transforming the transformed-source-identified-frame into at least one source-identified-frame.

As broadly described herein, the method of the present invention for processing data for multiple channels includes the step of combining, responsive to a source-identified-frame, the source-identified-frame into at least one data channel.

Additional objects and advantages of the invention are set forth in part in the description that follows, and in part are obvious from the description, or may be learned by practice of the invention. The objects and advantages of the invention may also be realized and attained by means of the steps, instrumentalities, and combinations particularly set out in the appended claims.

BRIEF DESCRIPTION OF THE DRAWINGS

The accompanying drawings, which are incorporated in and constitute part of the Specification, illustrate preferred embodiments of the invention, and together with the description, serve to explain the principles of the invention.

DETAILED DESCRIPTION OF THE PREFERRED EMBODIMENTS

Figure 1:
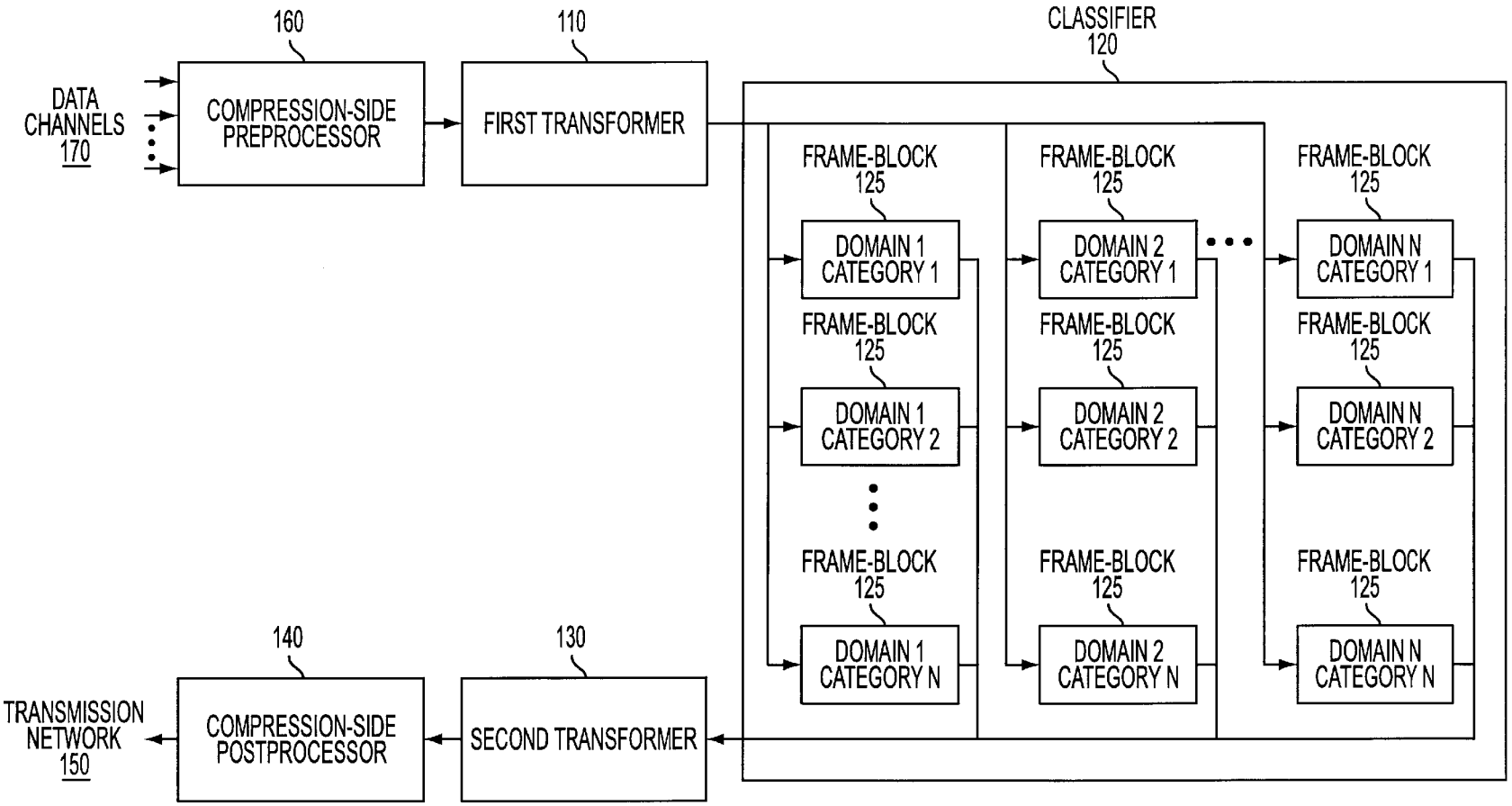
FIG. 1 is a diagram depicting a preferred embodiment of a system of the present invention for processing data from multiple channels.

Reference will now be made in detail to the present preferred embodiments of the invention, examples of which are illustrated in the accompanying drawings, wherein like reference numerals indicate like elements throughout the several views.

This Detailed Description of the Preferred Embodiments contains five sections. The first section, entitled "System for processing data from multiple channels (Compression-side)," describes the system of the present invention for compressing data received from multiple channels. The second section, entitled "System for processing data for multiple channels (Decompression-side)," describes the system of the present invention for decompressing data for transmission to multiple channels. The third section, entitled "Method for processing data from multiple channels (Compression-side)," describes the method of the present invention for compressing data received from multiple channels. The fourth section, entitled "Method for processing data for multiple channels (Decompression-side)," describes the method of the present invention for decompressing data for transmission to multiple channels. Finally, the fifth section, entitled "A Comprehensive Example," describes a preferred embodiment and example of systems of the present invention.

System for Processing Data from Multiple Channels (Compression-side)

FIG. 1 depicts a preferred embodiment of a system, comprising a combination of elements, for processing data from multiple channels. As depicted in FIG. 1, the system includes Compression-side Preprocessor 160 in communication with Data Channels 170 and First Transformer 110, First Transformer 110 in communication with Compression-side Preprocessor 160 and Classifier 120, Classifier 120 in communication with First Transformer 110 and Second Transformer 130, Second Transformer 130 in communication with Classifier 120 and Compression-side Postprocessor 140, and Compression-side Postprocessor 140 in communication with Second Transformer 130 and Transmission Network 150.

There is first provided an overview of the system, then each of the elements is discussed in detail.

Overview

In an example that will be continued throughout this section and the following section, and in a preferred embodiment, the system of the present invention for processing data from multiple channels is used to compress a plurality of standard telephone voice-grade channels carrying continuous analog human speech, that have been sampled and digitized, for efficient transmission across a packet-switched network. In this example, Data Channels 170 are the voice-grade channels and Transmission Network 150 is the packet-switched network. Compression-side Preprocessor 160 continuously segments each active voice channel, and collects the digital data into "frames," where each frame contains data from a single channel for a fixed and known timeslice. In a preferred embodiment that will be used in this example, each element of the invention operates sequentially on a "collection" of timeslices where the collection contains one timeslice from each active voice channel. The frames in a particular collection may or may not be contemporaneous with each other. Thus, Compression-side Preprocessor 160 fills a collection of frames with digitized speech data for the duration of a time slice. Compression-side Preprocessor 160 then makes that collection of frames available to First Transformer 110, and Compression-side Preprocessor 160 begins to fill a new collection of frames representing the next timeslice. In preferred embodiments, as is known in the art, Compression-side Preprocessor 160 also provides the necessary signaling for Data Channels 170, monitors the call status of each of Data Channels 170 and only processes data for active channels. Compression-side Preprocessor 160 also creates a set of information referred to herein as identification information that is used to keep track of the status of each Data Channel 170 and to record the origin of each frame so that the contents of Data Channels 170 can be at least approximately reconstructed, as described below, after the compressed data from Data Channels 170 are received from Transmission Network 150 and decompressed.

In a preferred embodiment, Compression-side Preprocessor 160 may receive many more data channels of Data Channels 170 than are designed to be processed as a collection by the other elements of the invention. In this case, as is known in the art, each data channel of Data Channels 170 may be assigned to a specific "supergroup." The channels forming a particular supergroup are placed in the same collection by Compression-side Preprocessor 160. For example, if the maximum size of a collection is 20 channels, and there are a total of 35 Data Channels 170, then Channel #1 through Channel #20 may be assigned to Supergroup #1 and Channel #21 through Channel #35 may be assigned to Supergroup #2. The first collection to be processed by the invention may be the channels in Supergroup #1. Then, the second collection to be processed will be the channels in Supergroup #2, the third collection to be processed will be the channels in Supergroup #1, and so forth. During processing by the invention, data elements in a particular collection are not combined or otherwise processed with data elements from other collections. Thus, no attempt is made to reduce or eliminate redundancies between data elements in different collections.

Continuing with the example and in a preferred embodiment, Compression-side Preprocessor 160 provides First Transformer 110 with collections of frames referred to as source-identified-frames, and also provides First Transformer 110 with identification information. In a preferred embodiment, First Transformer 110 performs, as is known in the art, a Linear Predictive Coding-type (LPC) transformation on each source-identified-frame in the collection currently being transformed. This transformation results in the production of two frames, referred to as transformed-source-identified-frames, for every source-identified-frame. As is known in the art, in a preferred embodiment, one of the transformed-source-identified-frames transformed from a particular source-identified-frame contains line spectra (as is known in the art, LPC-type transformations generally produce prediction or reflection coefficients which may be readily converted to line spectra), while the other transformed-source-identified-frame contains a residual excitation signal. Identification information is associated with each transformed-source-identified-frame, as is known in the art, so that the reconstruction of Data Channels 170 can eventually be performed.

Continuing with the example and in a preferred embodiment, First Transformer 110 provides Classifier 120 with collections of frames where each collection consists of transformed-source-identified-frames. As will be described in detail below, Classifier 120 groups the transformed-source-identified-frames in each collection into a collection of Frame-blocks 125 where transformed-source-identified-frames having similar characteristics are grouped in the same Frame-block 125. Identification information is associated with each Frame-block 125 and with each transformed-source-identified-frame that has been grouped into each Frame-block 125.

Continuing with the example and in a preferred embodiment, Classifier 120 provides Second Transformer 130 with collections of Frame-blocks 125. As will be described in detail below, Second Transformer 130 performs, as is known in the art, a two-dimensional transform on each Frame-block 125 in each collection, thus resulting in collections of transformed-frame-blocks. Identification information is associated with each transformed-frame-block.

Continuing with the example and in a preferred embodiment, Second Transformer 130 provides Compression-side Postprocessor 140 with collections of transformed-frame-blocks. As will be described below, Compression-side Postprocessor 140 performs, as is known in the art, compression of each transformed-frame-block, with identification information being associated with each compressed transformed-frame-block, and transmits the compressed transformed-frame-blocks and associated identification information to Transmission Network 150 as data-streams. In preferred embodiments, as is known in the art, Compression-side Postprocessor 140 also performs packetization of the compressed transformed-frame-blocks, compression and packetization of identification information associated with each compressed transformed-frame-block, and signaling with Transmission Network 150.

Preprocessor

In the preferred embodiment depicted in FIG. 1, Compression-side Preprocessor 160 is in communication with Data Channels 170 and First Transformer 110, and has means for receiving a plurality of Data Channels 170 and means for segmenting at least one of Data Channels 170 into a plurality of source-identified-frames.

In preferred embodiments, Compression-side Preprocessor 160 may be implemented by circuitry and/or software, as is known in the art. In preferred embodiments, Compression-side Preprocessor 160 may be fully implemented in software running on a general or special purpose digital computer.

In preferred embodiments, as is known in the art, the receiving means of Compression-side Preprocessor 160 accepts data from Data Channels 170. Each of the plurality of Data Channels 170 may be analog or digital, and may be continuous or packetized, in any combination. As is known in the art, circuitry and software in Compression-side Preprocessor 160 may interface to any such Data Channels 170 for the receipt of data and the exchange of signaling. As described in the continuing example in this specification and in a preferred embodiment, each of the plurality of Data Channels 170 is a telephone-type voice grade data channel as is provided by telephone system central offices; each of the plurality of Data Channels 170 carries digitized telephone system voice communications; and, as is known in the art, Compression-side Preprocessor 160 contains the circuitry and software required to interface with such telephone data channels.

In preferred embodiments, as is known in the art, the segmenting means of Compression-side Preprocessor 160 segments at least one of the Data Channels 170 into a plurality of source-identified-frames. As described in the continuing example and in a preferred embodiment, each of the plurality of Data Channels 170 carries digitized telephone speech data (derived from original analog telephone speech data) and the segmenting means, as is known in the art, sequentially captures fixed-time-duration portions of the digital speech data. The result of this segmenting operation is a series of discrete "frames" of data elements. As is known in the art, these frames represent digitized time slices of the original analog speech data. Typically, in a preferred embodiment, each frame represents a time slice of approximately 20 milliseconds of speech, where time slices of more than approximately 30 milliseconds may introduce unacceptable overall transmission delays and time slices of less than approximately 20 milliseconds may reduce the efficiency of the compression operation. Certain transformation techniques, such as the LPC transformation, may also be less effective for time slices of more than approximately 30 milliseconds because, as is know in the art, these transformations take advantage of the approximate statistical stationarity of human speech that has a typical maximum duration of between 30 milliseconds and 50 milliseconds.

The source of each frame is identified by associating it with appropriate identification information. In various preferred embodiments, identification information may be placed in each frame, may be transported separately from the frame, or may be divided so that a portion of the identification information is carried in each frame and a portion is carried separately as side information. Other techniques for identifying frames and transporting this identification information are known in the art. In a preferred embodiment, the identification information contains information on the status of each data channel of the plurality of Data Channels 170.

In preferred embodiments, each of Data Channels 170 may transport data in any known and prespecified combination of analog or digital, continuous or packetized data. As is known in the art, the segmenting means of Compression-side Preprocessor 160 includes circuitry and/or software for converting data into source-identified-frames.

In the continuing example and in a preferred embodiment, Compression-side Preprocessor 160, as is known in the art, identifies channels that are not actively transporting data (i.e., inactive channels). For example, in a telephone system, a number of speech data channels connected to Compression-side Preprocessor 160 may be unused, while only a few speech data channels connected to Compression-side Preprocessor 160 are actively transporting speech data at a particular point in time. In a preferred embodiment, the identification information includes information on the active or inactive status of each channel, and Compression-side Preprocessor 160 does not segment data from inactive data channels into source-identified-frames.

First Transformer

In the preferred embodiment depicted in FIG. 1, First Transformer 110 is in communication with Compression-side Preprocessor 160 and Classifier 120, and has means for receiving a plurality of source-identified-frames, and means for transforming at least one source-identified-frame into at least one transformed-source-identified-frame.

In preferred embodiments, First Transformer 110 may be implemented by circuitry and/or software as is known in the art. First Transformer 110 may be fully implemented in software running on a general or special purpose digital computer.

In preferred embodiments, as is known in the art, the receiving means of First Transformer 110 accepts source-identified-frames, and associated identification information, from Compression-side Preprocessor 160 and makes them available for further processing by First Transformer 110.

In preferred embodiments, as is known in the art, the transforming means of First Transformer 110 applies a data transformation operation to each source-identified-frame. The application of the data transformation operation to a source-identified-frame results in the production of one or more transformed-source-identified-frames. Some data transformation operations result, for each source-identified-frame, in the production of multiple transformed-source-identified-frames that have general characteristics that are mathematically distinguishable from each other. Each mathematically distinguishable category of transformed-source-identified-frame is referred to herein as a "domain type."

In the continuing example and in a preferred embodiment, the data transformation operation applied by First Transformer 110 is performed using a Linear Predictive Coding (LPC) transformation as is known in the art. In this preferred embodiment, the data contained in each source-identified-frame is preprocessed with a $1^{st}$-order preemphasis filter, with an "a" value of approximately 0.9 as is known in the art, before performing the LPC transformation. Also, a 15 Hz bandwidth expansion of the LPC predictor prior to transformation to line spectra may be employed. In preferred embodiments utilizing LPC transformations, each source-identified-frame is transformed into a transformed-source-identified-frame containing vocal-tract parameters and into a transformed-source-identified-frame containing a residual excitation signal. As is known in the art, in transformed-source-identified-frames containing vocal-tract parameters, in a preferred embodiment those parameters are expressed as line spectra and the line spectra are made up of one or more line spectra values. In a preferred embodiment, line spectra contained in transformed-source-identified-frames are made up of ten line spectra values.

In a preferred embodiment, each transformed-source-identified-frame containing vocal-tract parameters expressed as line spectra is further processed by subtracting a precalculated set of average line spectra values from the values of the line spectra (the resulting processed line spectra values are referred to as "mean-removed line spectra values"). As is known in the art, the set of average line spectra values may be calculated from sample speech data for the particular application. In a preferred embodiment, the precalculated set of line spectra values forms a vector and the line spectra value for each position in this vector is calculated by applying an LPC transformation to a collection of sample speech data and then taking an arithmetic average of the corresponding line spectra values derived from the collection of sample speech data. For example, a 10 element set of average line spectra values derived from a collection of speech data for experimental purposes is (in Hz): {286, 488, 889, 1241, 1577, 1970, 2265, 2757, 3154, 3482}. In a preferred embodiment, this set of spectral values is then subtracted from transformed-source-identified-frames containing line spectra values in order to reduce the dynamic range of the resulting processed spectral values. Other methods for reducing the dynamic range of transformed-source-identified-frames containing vocal-tract parameters may also be employed as is known in the art.

In preferred embodiments, identification information is maintained during the transformation process, as is known in the art, so that each transformed-source-identified-frame derived from a source-identified-frame can be related back to that source-identified-frame.

Classifier

In the preferred embodiment depicted in FIG. 1, Classifier 120 is in communication with First Transformer 110 and Second Transformer 130, and has means for receiving at least one transformed-source-identified-frame from First Transformer 110; means for categorizing the at least one transformed-source-identified-frame by domain type, where there is at least one prespecified domain type; means for categorizing the at least one transformed-source-identified-frame by category type, where there is at least one prespecified category type; and means, responsive to the domain type and category type of each transformed-source-identified-frame, for grouping the transformed-source-identified-frame into at least one frame-block.

In preferred embodiments, Classifier 120 may be implemented by circuitry and/or software, as is known in the art. Classifier 120 may be fully implemented in software running on a general or special purpose digital computer.

In preferred embodiments, as is known in the art, the receiving means of Classifier 120 accepts transformed-source-identified-frames from First Transformer 110 and makes them available for further processing by Classifier 120. In preferred embodiments, the receiving means also accepts identification information from First Transformer 110 as part of the transformed-source-identified-frames.

In preferred embodiments, as is known in the art, the domain type categorizing means of Classifier 120 relates a transformed-source-identified-frame to a prespecified domain type. As described above, the transformation performed by First Transformer 110 may create transformed-source-identified-frames corresponding to one or more mathematically distinguishable domain types. Any transformation performed by First Transformer 110 will create a transformed-source-identified-frame corresponding to at least one domain type. As is known in the art, the domain type categorizing means determines the domain type of each transformed-source-identified-frame that it processes and includes the domain type in the identification information associated with the transformed-source-identified-frame being processed.

In the continuing example and in a preferred embodiment, transformed-source-identified-frames containing vocal-tract parameters are categorized according to a first domain type related to vocal-tract parameters, while transformed-source-identified-frames containing a residual excitation signal are categorized according to a second domain type related to residual excitation signals.

In preferred embodiments, as is known in the art, the category-type categorizing means of Classifier 120 relates a transformed-source-identified-frame to one or more prespecified category types. As is known in the art, category types are selected such that the data contained in transformed-source-identified-frames that are assigned the same category type will have certain similar statistical characteristics that are based on the origins of the data. The relevant statistical characteristics are those that facilitate compression when a specified compression technique is applied to a group of transformed-source-identified-frames having the same category type.

In the continuing example and in a preferred embodiment, and where compression operations employ lossless coding methods including, for example, run-length coding and variable-length coding methods, categories related to the mechanisms of human speech production have been found to facilitate the compression operation. In particular, transformed-source-identified-frames may be categorized as containing speech data that represent silence, quiet, voiced speech, unvoiced speech, and various transitional categories between, for example, quiet to voiced speech, voiced speech to unvoiced speech, and unvoiced speech to voiced speech. The use of additional category types may permit higher degrees of compression; however, diminishing efficiency improvements may be experienced when large numbers of category types are employed due to theoretical limits on compressability, the overhead required to process additional categories, and other design considerations as are known in the art. In a preferred embodiment, the category-type categorizing means, as is known in the art, relates transformed-source-identified-frames to category types of the silence type, the voiced type, and the unvoiced type. In an alternative preferred embodiment, the category-type categorizing means, as is known in the art, relates transformed-source-identified-frames to category types of the silence type, quiet type, voiced type, unvoiced type, and the following transitional types: silence to voiced type, silence to unvoiced type, voiced to silence type, unvoiced to silence type, quiet to voiced type, quiet to unvoiced type, unvoiced to quiet type, and voiced to quiet type. In preferred embodiments, as is known in the art, the category-type categorizing means includes the category type in the identification information associated with the transformed-source-identified-frame being processed.

In some embodiments with multiple domain types, it may not be necessary to categorize transformed-source-identified-frames with certain domain types into multiple category types. For example, in a preferred embodiment where transformed-source-identified-frames containing vocal-tract parameters are categorized according to a first domain type related to vocal-tract parameters and where transformed-source-identified-frames containing a residual excitation signal are categorized according to a second domain type related to residual excitation signals, the category-type categorizing means of Classifier 120 relates all transformed-source-identified-frames having the first domain type related to vocal-tract parameters to a single prespecified category type.

Classifier 120 has means, responsive to the domain type and the category type of each transformed-source-identified-frame, for grouping each transformed-source-identified-frame into at least one Frame-block 125, as depicted in FIG. 1. In preferred embodiments, as is known in the art, the domain type and category type contained in the identification information associated with each transformed-source-identified-frame is used to group together transformed-source-identified-frames having identical domain and category types.

In preferred embodiments, such as when dyadic Daubechies orthogonal wavelet transforms are used by Second Transformer 130, the size of each Frame-block 125 may be dynamically adjusted, as is known in the art, to contain all of the transformed-source-identified-frames in a single collection that have identical domain and category types.

In the continuing example and in a preferred embodiment, each Frame-block 125 contains a prespecified number, which may advantageously be a multiple of a power of two, such as eight, of transformed-source-identified-frames. Thus, for example, up to eight transformed-source-identified-frames having a "line spectra" domain type and a "voiced" category type will be grouped into a single Frame-block 125, up to eight transformed-source-identified-frames having a "line spectra" domain type and an "unvoiced" category type will be grouped into another Frame-block 125, and so forth. As is known in the art, the prespecified size of each frame-block will be selected based on overall design considerations. Typically, however, this number will be much larger than eight, such as 32, 64, or 128.

In the continuing example and in a preferred embodiment, all of the transformed-source-identified-frames (referred to herein as live transformed-source-identified-frames) in a single collection are distributed, by Classifier 120, to Frame-blocks 125, and these Frame-blocks 125 are made available to Second Transformer 130 for further processing, before the next collection of transformed-source-identified-frames is distributed into a new set of Frame-blocks 125. Thus, due to the fixed size of each Frame-block 125 and the limited number of transformed-source-identified-frames in a single collection, it is possible that some Frame-blocks 125 collecting transformed-source-identified-frames of certain domain and category types will not be completely filled by the available transformed-source-identified-frames, some combinations of domain and category types will not be represented by any Frame-block 125, and multiple Frame-blocks 125 may contain transformed-source-identified-frames having the same domain and category types.

In preferred embodiments where Frame-blocks 125 of fixed size may only be partially filled, the unfilled portions of Frame-blocks 125 may be "padded", as is known in the art, with "dummy" transformed-source-identified-frames that contain zeroed values. In alternative preferred embodiments, dummy transformed-source-identified-frames that are used for padding may be created using techniques as are known in the art and as are described below. The use of more complex techniques for generating dummy transformed-source-identified-frames and for arranging such frames within frame-blocks, as described below, may not, however, result in improved overall compression efficiency due to the overhead required to generate, manipulate, and keep track of such frames.

In the continuing example and in a preferred embodiment, partially filled Frame-blocks 125 having domain types related to line spectra may be padded by filling the remainder of Frame-block 125 with additional copies, as required, of the last transformed-source-identified-frame to be grouped into Frame-block 125. As is known in the art, the selection of methods to pad partially filled Frame-blocks 125 having domain types related to residual excitation signals depends on the selection of the transform to be used by Second Transformer 130. When transforms such as the dyadic discrete wavelet transform are used, padding is preferably performed, as is known in the art, by filling the remainder of Frame-block 125 with a symmetrical or cyclical mirror image of the transformed-source-identified-frames that were grouped into Frame-block 125. For example, if a Frame-block 125 with a prespecified size of eight contains three transformed-source-identified-frames denoted here as resid1, resid2, and resid3, Frame-block 125 may be filled, including padding in a symmetrical manner as follows:

resid1, resid2, resid3, resid3, resid3, resid3, resid2, resid1
or cyclically, either as:

resid1, resid2, resid3, resid2, resid1, resid2, resid3, resid2
or as:

resid1, resid2, resid3, resid3, resid2, resid1, resid1, resid2.

When the two-dimensional DCT transform is used, padding should be performed, as is known in the art, by filling the remainder of Frame-block 125 with additional copies, as required, of the last transformed-source-identified-frame to be grouped into Frame-block 125 (which is the same padding method as that may be used for domain types related to line spectra).

In preferred embodiments and prior to any padding operations as described above, as known in the art, the efficiency of compression may be improved by re-ordering (also referred to herein as "arranging") the transformed-source-identified-frames contained in each Frame-block 125. As discussed above, however, such arranging may not result in improved overall compression efficiency due to the overhead required to generate and keep track of such arranging.

In the continuing example and in a preferred embodiment, the grouping means of Classifier 120 includes means for arranging the transformed-source-identified-frames grouped into at least one Frame-block 125. As is known in the art, a variety of arranging techniques may be used to arrange transformed-source-identified-frames grouped in Frame-blocks 125. In a preferred embodiment, with Frame-blocks 125 having domain types related to residual signals, transformed-source-identified-frames may be arranged in Frame-blocks 125 in any convenient manner, as is known in the art. In preferred embodiments of arranging means for Frame-blocks 125 having domain types related to line spectra, for example as described below in this section, the line spectra values being arranged on are mean-removed line spectra values.

In a preferred embodiment, with Frame-blocks 125 having domain types related to line spectra, and as is known in the art, the arranging means includes means for averaging the line-spectra-values of each transformed-source-identified-frame that is grouped in Frame-block 125, and the arranging means arranges the transformed-source-identified-frames in order of the lowest average line-spectra-values to the highest average line-spectra-values (for example, arranged in a {1, 2, 3, 4, 5, 6, 7, 8} pattern of values). In alternative preferred embodiments, the transformed-source-identified-frames may be arranged by average line-spectra-values such that the highest average line-spectra-value is in the center of Frame-block 125 and the other values are arranged in symmetrical decreasing order about the highest average line-spectra-value (for example, arranged in a {2, 4, 6, 8, 7, 5, 3, 1} pattern of values), or the lowest average line-spectra-value is in the center of Frame-block 125 and the other values are arranged in symmetrical increasing order about the lowest average line-spectra-value (for example, arranged in a {8, 6, 4, 2, 1, 3, 5, 7} pattern of values).

In an alternate preferred embodiment, with Frame-blocks 125 having domain types related to line spectra, and as is known in the art, the arranging means includes means for selecting, in accordance with predefined criteria, a subset of the line-spectra-values of each transformed-source-identified-frame that is grouped in Frame-block 125. The arranging means also includes means for averaging the subset of the line-spectra-values, and arranging the transformed-source-identified-frames in order of the lowest average subset of line-spectra-values to the highest average subset of line-spectra-values (for example, arranged in a {1, 2, 3, 4, 5, 6, 7, 8} pattern of values). In alternative preferred embodiments, the transformed-source-identified-frames may be arranged by average subset of line-spectra-values such that the highest average subset of line-spectra-values is in the center of Frame-block 125 and the other values are arranged in symmetrical decreasing order about the highest average subset of line-spectra-values (for example, arranged in a {2, 4, 6, 8, 7, 5, 3, 1} pattern of values), or the lowest average subset of line-spectra-values is in the center of Frame-block 125 and the other values are arranged in symmetrical increasing order about the lowest average subset of line-spectra-values (for example, arranged in a {8, 6, 4, 2, 1, 3, 5, 7} pattern of values).

In a preferred embodiment, as is known in the art, the predefined criteria for selecting the subset is to select between three and five of the lowest line-spectra-values in the transformed-source-identified-frame. As is known in the art, other methods for selecting a subset of line spectra values may be employed.

In an alternate preferred embodiment, with Frame-blocks 125 having domain types related to line spectra and with Frame-blocks 125 having domain types related to residual excitation signals, and as is known in the art, the arranging means includes means for associating an average-frame-energy with each transformed-source-identified-frame that is grouped in Frame-block 125. The arranging means arranges the transformed-source-identified-frames in order of the lowest average-frame-energy to the highest average-frame-energy. In a preferred embodiment, the average-frame-energy arranging method described in this paragraph is applied only to Frame-blocks 125 having a second domain type related to residual excitation signals.

In an alternate preferred embodiment, with Frame-blocks 125 having domain types related to line spectra and with Frame-blocks 125 having domain types related to residual signals, and as is known in the art, the arranging means includes means for associating an average-frame-energy with each source-identified-frame from which each transformed-source-identified-frame that is grouped in Frame-block 125 was transformed. The arranging means arranges the transformed-source-identified-frames in order of the transformed-source-identified-frame associated with the source-identified-frame having the lowest average-frame-energy to the transformed-source-identified-frame associated with the source-identified-frame having the highest average-frame-energy.

In an alternate preferred embodiment, with Frame-blocks 125 having domain types related to residual signals, and as is known in the art, the arranging means includes means for associating a zero-crossing-rate with each transformed-source-identified-frame that is grouped in Frame-block 125, and the arranging means arranges the transformed-source-identified-frames in order of the lowest zero-crossing-rate to the highest zero-crossing-rate.

In an alternate preferred embodiment, with Frame-blocks 125 having domain types related to residual signals, and as is known in the art, the arranging means includes means for associating a zero-crossing-rate with each source-identified-frame from which each transformed-source-identified-frame that is grouped in Frame-block 125 was transformed. The arranging means arranges the transformed-source-identified-frames in order of the transformed-source-identified-frame associated with the source-identified-frame having the lowest zero-crossing-rate to the transformed-source-identified-frame associated with the source-identified-frame having the highest zero-crossing-rate. In preferred embodiments, the zero-crossing-rate of source-identified-frames may be determined as a necessary artifact of the operation of Classifier 120, as is known in the art.

In additional alternate preferred embodiments, other arranging means may be employed as are known in the art. In preferred embodiments, the averaging means, selecting means, and the arranging means may be implemented by circuitry and/or software as is known in the art. The averaging means, the selecting means, and the arranging means also may be fully implemented in software running on a general or special purpose digital computer.

In preferred embodiments, identification information is maintained during any arranging and/or padding operations so that the source of each transformed-source-identified-frame can be determined. When decompression is conducted, if transformed-source-identified-frames that were generated for use as padding are transmitted to the decompression-side, then it will be necessary to discard any such transformed-source-identified-frames as described in more detail below.

In a preferred embodiment where there is a plurality of domain types, it may be desirable to apply an arranging method only to those Frame-blocks 125 of a specific domain type, thus creating a set of arranged Frame-blocks 125 that all have the same domain type and that have various category types. For Frame-blocks 125 of each category type, Frame-blocks 125 with other than the specific domain type may then subsequently be arranged by following the sequence of arrangement used in the Frame-blocks 125 with the specific domain type and with the same category type, as is known in the art. This approach may result in less compression efficiency for some individual Frame-blocks 125, but the identification information for some transformed-source-identified-frames may be reduced, as is known in the art, since Frame-blocks 125 with other than the specific domain type are all arranged by a single known pattern.

Second Transformer

In the preferred embodiment depicted in FIG. 1, Second Transformer 130 is in communication with Classifier 120 and Compression-side Postprocessor 140, and has means for receiving at least one Frame-block 125 from Classifier 120, and means for transforming at least one Frame-block 125 into at least one transformed-frame-block.

In preferred embodiments, Second Transformer 130 may be implemented by circuitry and/or software as is known in the art. Second Transformer 130 may be fully implemented in software running on a general or a special purpose digital computer.

In preferred embodiments, as is known in the art, the receiving means of Second Transformer 130 accepts Frame-blocks 125, including identification information, from Classifier 120 and makes them available for further processing by Second Transformer 130.

In preferred embodiments, as is known in the art, the transforming means of Second Transformer 130 applies a data transformation operation to each of Frame-blocks 125 resulting in a transformed-frame-block for each of Frame-blocks 125. In preferred embodiments, the data transformation operation includes a forward two-dimensional transform. As is known in the art, a variety of forward two-dimensional transforms may be employed, including without limitation Fourier transforms, Fast Fourier transforms, wavelet transforms, Discrete Sine transforms ("DST"), Discrete Cosine transforms ("DCT"), the Haar transform, the Walsh transform (also referred to as the Walsh-Hadamard transform), and the Karhunen-Loeve transform ("KLT"). Identification information is associated with each transformed-frame-block, based on the identification information associated with Frame-blocks 125 obtained from Classifier 120.

Many, but not all, forward two-dimensional transformations consist of repeated applications of one-dimensional transformations. In preferred embodiments, a one-dimensional transform of a certain type may be combined with a one-dimensional transform of another type to form a forward two-dimensional transform. Each Frame-block 125 may be considered a matrix, with each transformed-source-identified-frame that is contained in Frameblock 125 forming a row in the matrix so that the positions of data elements within each transformed-source-identified-frame (i.e., within each row) form the columns of the matrix. A one-dimensional transform is applied to each row of the matrix to form a resultant matrix, and then another one-dimensional transform is applied to each of the columns of the resultant matrix.

In the continuing example of this specification and in a preferred embodiment, Second Transformer 130 employs, as is known in the art, a three level dyadic two-dimensional Daubechies "D4" forward wavelet transform for both Frame-blocks 125 having a domain type related to line spectra and Frame-blocks 125 having a second domain type related to residual excitation signals.

In a preferred embodiment, certain rows in transformed-frames-blocks are deleted before the transformed-frames-blocks are provided to Compression-side Postprocessor 140 for further processing. The certain rows that are deleted preferably correspond to the rows that were added, if any, in Frame-blocks 125 for padding as described above.

Postprocessor

In the preferred embodiment depicted in FIG. 1, Compression-side Postprocessor 140 is in communication with Second Transformer 130 and Transmission Network 150, and has means for receiving at least one transformed-frame-block from Second Transformer 130, means for compressing at least one transformed-frame-block into at least one data-stream, and means for transmitting at least one data-stream to Transmission Network 150.

In preferred embodiments, Compression-side Postprocessor 140 may be implemented by circuitry and/or software as is known in the art. Compression-side Postprocessor 140 may be fully implemented in software running on a general or special purpose digital computer.

In preferred embodiments, as is known in the art, the receiving means of Compression-side Postprocessor 140 accepts transformed-frame-blocks, including identification information, from Second Transformer 130 and makes them available for further processing by Compression-side Postprocessor 140.

In preferred embodiments, the compressing means of Compression-side Postprocessor 140 compresses transformed-frame-blocks, including identification information, into at least one data-stream. A wide variety of compression techniques, as are known in the art, may be employed alone or in combination, including without limitation, quantization, scaling, Run-Length Coding ("RLE"), Lempel-Zev-Welch ("LZW"), arithmetic coding, differential coding, adaptive differential coding, Burrows-Wheeler Transformation ("BWT"), and move-to-front ("MTF") coding. In a preferred embodiment, a block-sorting rearrangement operation, for example the Burrows-Wheeler Transformation ("BWT") as is known in the art, is performed between lossless entropy coding operations.

In the continuing example and in a preferred embodiment, as is known in the art, the compression technique of quantization and scaling followed by the BWT and then RLE is employed. In detail, in this embodiment the contents of each transformed-frame-block are quantized and read out. Each transformed-frame-block may be viewed as a two-dimensional array and the read-out may be conducted by rows or columns of the array as is known in the art. There may, however, be some benefit to reading-out the arrays in a zig-zag manner in order to maximize local (spatial) correlation within each array. Thus, for example, a 4×4 transformed-frame-block contains 16 positions as follows:

| | | | |
|---|---|---|---|
| 01 | 02 | 03 | 04 |
| 05 | 06 | 07 | 08 |
| 09 | 10 | 11 | 12 |
| 13 | 14 | 15 | 16 |

The example 4×4 transformed-frame-block may be read-out in a zig-zag manner as {01, 05, 02, 09, 06, 03, 13, 10, 07, 04, 08, 11, 14, 15, 12, 16} or in other zig-zag manners as are known in the art. In preferred embodiments, the size of each transformed-frame-block, treated as an array, will be larger than 4×4.

The read-out data is then sequentially processed by a lossless run-length encoder to remove long runs of the same value. The output of the run-length encoder is subjected to a Burrows-Wheeler Transform, which results in a sequence of data items and an index value. This sequence of data items is processed by a move-to-front coder and then by another run-length encoder. The result of this second run-length encoding is processed by an arithmetic coder and the output of the arithmetic coder, as well as the index value, forms part of a data-stream for transmission by Transmission Network 150. Additional transformed-frame-blocks are processed into data streams in a similar manner. In alternative preferred embodiments, a Huffman coder or other lossless entropy coder may be employed in place of the arithmetic coder.

In a preferred embodiment, the compressing means of Compression-side Postprocessor 140 comprises means for converting at least one transformed-frame-block to a differential representation. As is known in the art, in using a differential representation, the contents of a transformed-frame-block are replaced by the differences between the contents of the current transformed-frame-block and a pre-specified transformed-frame-block that was previously compressed by Compression-side Postprocessor 140. When the differences between the current transformed-frame-block and the previous transformed-frame-block are small, the resulting representation for the current transformed-frame-block may be much more compact than the original representation of the transformed-frame-block. In the continuing example and in a preferred embodiment, as is known in the art, an initial collection of transformed-frame-blocks may be compressed and transmitted using the original representations of the transformed-frame-blocks. Then, a series of subsequent collections of transformed-frame-blocks are compressed and transmitted using differential representations based on each previous collection. To reduce the effects of cumulative error caused by lossy compression and by transmission errors, as is known in the art, it is preferable to intersperse transmissions of collections using differential representations with occasional transmissions of collections using the original representations.

In preferred embodiments, as is known in the art, the transmitting means of Compression-side Postprocessor 140 transmits at least one data-stream to Transmission Network 150. Transmission Network 150 may be analog or digital, continuous or packetized, in any combination. As is known in the art, circuitry and software in Compression-side Postprocessor 140 may interface to any such Transmission Network 150 for the transmission of data-streams and the exchange of signaling.

As described in the continuing example and in a preferred embodiment, Transmission Network 150 is a packet-switched network and the transmitting means of Compression-side Postprocessor 140 packetizes the data-streams and makes them available to the packet-switched network.

In the continuing example and in a preferred embodiment, as is known in the art, packets prepared by the transmitting means of Compression-side Postprocessor 140 include a complete set of compressed data representing a single collection off transformed-frame-blocks and identification information. The identification information may also identify the collection as belonging to a particular supergroup. A header attached to the packet, as is known in the art, will include synchronization information, and may include routing and other identification information.

System for Processing Data for Multiple Channels (Decompression-side)

Figure 2:
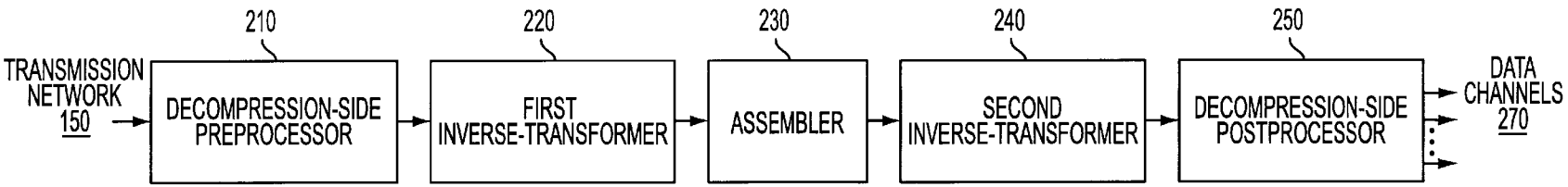
FIG. 2 is a diagram depicting a preferred embodiment of a system of the present invention for processing data for multiple channels.

FIG. 2 depicts a preferred embodiment of a system, comprising a combination of elements, for processing data for multiple channels. As depicted in FIG. 2, the system includes Decompression-side Preprocessor 210 in communication with Transmission Network 150 and First Inverse-Transformer 220, First Inverse-Transformer 220 in communication with Decompression-side Preprocessor 210 and Assembler 230, Assembler 230 in communication with Second Inverse-Transformer 240 and First Inverse-Transformer 220, Second Inverse-Transformer 240 in communication with Assembler 230 and Decompression-side Postprocessor 250, and Decompression-side Postprocessor 250 in communication with Second Inverse-Transformer 240 and Data Channels 270.

There is first provided an overview of the system, then each of the elements is described in detail.

Overview

In an example that will be continued throughout this section, and in a preferred embodiment, the system of the present invention for processing data for multiple channels is used to decompress data, for a plurality of standard telephone voice-grade channels carrying continuous digitized human speech, that have been transported across a packet switched network in conjunction with the system for processing data from multiple channels described in the previous section. As depicted in FIG. 2, Data Channels 270 are the voice-grade channels and Transmission Network 150 is the packet switched network. Decompression-side Preprocessor 210 receives compressed and packetized data-streams that have been created using the compression system described above. The compressed data-streams include not only the data content of Data Channels 170, but also identification information necessary to fully or approximately reconstruct the contents of each of the Data Channels 170. Decompression-side Preprocessor 210 decompresses the compressed data-streams into transformed-frame-blocks. As described in the previous section, in a preferred embodiment and continuing with the example, packets prepared by the transmitting means of Compression-side Postprocessor 140 included a complete set of compressed data representing a single collection of transformed-frame-blocks and identification information.

Continuing with the example and in a preferred embodiment, Decompression-side Preprocessor 210 processes a complete set of compressed data representing a single collection and associated identification information, and provides First Inverse-Transformer 220 with the transformed-frame-blocks of the collection and the identification information. As will be described in detail below, First Inverse-Transformer 220 transforms the transformed-frame-blocks in a collection into a collection of frame-blocks with associated identification information.

Continuing with the example and in a preferred embodiment, First Inverse-Transformer 220 provides Assembler 230 with the collection of frame-blocks and associated identification information. Assembler 230 separates the collection of frame-blocks into a collection of transformed-source-identified-frames and associated identification information.

Continuing with the example and in a preferred embodiment, Assembler 230 provides Second Inverse-Transformer 240 with the collection of transformed-source-identified-frames and associated identification information. Second Inverse-Transformer 240 transforms the collection of transformed-source-identified-frames into a collection of source-identified-frames. In preferred embodiments, Second Inverse-Transformer 240 operates on multiple transformed-source-identified-frames in order to produce a single source-identified-frame.

Continuing with the example and in a preferred embodiment, Second Inverse-Transformer 240 provides the collection of source-identified-frames and associated identification information to Decompression-side Postprocessor 250. As described in detail below, Decompression-side Postprocessor 250 converts the source-identified-frames of a collection into digital timeslices for transmission to Data Channels 270. In preferred embodiments, as is known in the art, Decompression-side Postprocessor 250 also provides the necessary signaling for Data Channels 270.

Preprocessor

In the preferred embodiment depicted in FIG. 2, Decompression-side Preprocessor 210 is in communication with Transmission Network 150 and First Inverse-Transformer 220, and has means for receiving at least one data-stream from Transmission Network 150 and means for decompressing the data-stream into at least one transformed-frame-block.

In preferred embodiments, Decompression-side Preprocessor 210 may be implemented by circuitry and/or software, as is known in the art. In preferred embodiments, Decompression-side Preprocessor 210 may be fully implemented in software running on a general or special purpose digital computer.

In preferred embodiments, as is known in the art, the receiving means of Decompression-side Preprocessor 210 includes the circuitry and/or software to accept data-streams and exchange signals with Transmission Network 150. Identification information associated with the data-streams is also received. In the continuing example and in a preferred embodiment, the data-streams were produced by the system for processing data from multiple channels of the present invention or by the method for processing data from multiple channels of the present invention (the compression side), and Transmission Network 150 is a packet-switched network.

In preferred embodiments the decompression means of Decompression-side Preprocessor 210 converts data-streams into transformed-frame-blocks. The selection of the decompression means is based, as is known in the art, on the quantization, scaling, and coding operations that were performed on the transformed-frame-blocks on the compression side. Based on the identification information associated with the data-streams, identification information is associated with the transformed-frame-blocks.

Consistent with the continuing example of the system for processing data from multiple channels described in the previous section, and in a preferred embodiment, each data stream received from Transmission Network 150 is first processed by arithmetic decoding. The result of the arithmetic decoding is processed by run-length decoding. The result of the run length decoding is processed by Move-To-Front decoding. The result of the Move-To-Front decoding is subjected to an inverse Burrows-Wheeler Transform. The result of the inverse Burrows-Wheeler Transform is processed again by run-length decoding. The result of this second run-length decoding operation is formed into a two-dimensional array by a zig-zag operation that is the inverse of the zig-zag operation used on the compression side. Finally, data within the two-dimensional array is dequantized, with the resulting array forming a transformed-frame-block that fully or approximately reconstructs a corresponding transformed-frame-block that was generated on the compression side. Additional data-streams are processed into transformed-frame-blocks in a similar manner.

In a preferred embodiment, as described in the previous section, certain transformed-source-identified-frames may be added to Frame-blocks 125 (as additional rows) for padding; and in this preferred embodiment, rows in the resulting transformed-frame-blocks that correspond to the rows added as padding are deleted prior to compression-side postprocessing. In preferred embodiments where such padding rows are deleted on the compression-side, it is preferable to add corresponding padding to transformed-frame-blocks on the decompression-side, based on the identification information, before the transformed-frame-blocks are inverse-transformed as described below. In preferred embodiments, rows added to transformed-frame-blocks for padding on the decompression-side have each data element set to zero.

First Inverse-Transformer

In the preferred embodiment depicted in FIG. 2, First Inverse-Transformer 220 is in communication with Decompression-side Preprocessor 210 and Assembler 230, and has means for receiving at least one transformed-frame-block from Decompression-side Preprocessor 210 and means for inverse-transforming the transformed-frame-block into at least one frame-block.

In preferred embodiments, First Inverse-Transformer 220 may be implemented by circuitry and/or software as is known in the art. First Inverse-Transformer 220 may be fully implemented in software running on a general or special purpose digital computer.

In preferred embodiments, as is known in the art, the receiving means of First Inverse-Transformer 220 accepts transformed-frame-blocks, and associated identification information, from Decompression-side Preprocessor 210 and makes them available for further processing by First Inverse-Transformer 220.

In preferred embodiments, as is known in the art, the inverse-transforming means of First Inverse-Transformer 220 applies a data transformation operation to the transformed-frame-blocks. The application of the data transformation operation to a transformed-frame-block results in the production of a frame-block. Based on the identification information associated with the transformed-frame-blocks, identification information is associated with the frame-blocks.

In preferred embodiments, the selection of the data transformation operation is based, as is known in the art, on the second transformation operation that was performed on the frame-block on the compression side. In a preferred embodiment, the data transformation operation of the First Inverse-Transformer 220 includes an inverse two-dimensional transform. In preferred embodiments, the inverse two-dimensional includes a transform that is selected from the group consisting of a Fourier transform, a Fast Fourier transform, a wavelet transform, a DST transform, a DCT transform, a Haar transform, a Walsh transform, and a KLT transform. As discussed above in connection with Second Transformer 130, two-dimensional transforms may be comprised of two one-dimensional transforms applied sequentially, as is known in the art.

In the continuing example and in a preferred embodiment, First Inverse-Transformer 220 employs, as is known in the art, a three level dyadic two-dimensional Daubechies "D4" inverse wavelet reconstruction and resynthesis on both transformed-frame-blocks having a first domain type related to line spectra and transformed-frame-blocks having a second domain type related to residual excitation signals.

Assembler

In the preferred embodiment depicted in FIG. 2, Assembler 230 is in communication with First Inverse-Transformer 220 and Second Inverse-Transformer 240, and has means for receiving at least one frame-block from First Inverse-Transformer 220 and means for separating at least one frame-block into at least one transformed-source-identified-frame.

In preferred embodiments, Assembler 230 may be implemented by circuitry and/or software as is known in the art. Assembler 230 may be fully implemented in software running on a general or special purpose digital computer.

In preferred embodiments, as is known in the art, the receiving means of Assembler 230 accepts frame-blocks, and associated identification information, from First Inverse-Transformer 220 and makes them available for further processing by Assembler 230.

In preferred embodiments, as is known in the art, the separating means of Assembler 230 performs a separating operation on the frame-blocks. The application of the separating operation to a frame-block results in the production of transformed-source-identified-frames that exactly or approximately correspond with the transformed-source-identified-frames that were grouped into the corresponding frame-block on the compression side. Based on the identification information associated with the frame-blocks, transformed-source-identified-frames that were grouped into the frame-blocks on the compression side as padding, or that were added on the decompression side as padding as described above, are discarded and identification information is associated with the remaining transformed-source-identified-frames.

Second Inverse-Transformer

In the preferred embodiment depicted in FIG. 2, Second Inverse-Transformer 240 is in communication with Assembler 230 and Decompression-side Postprocessor 250, and has means for receiving at least one transformed-source-identified-frame from Assembler 230 and means for inverse-transforming at least one transformed-source-identified-frame into at least one source-identified-frame.

In preferred embodiments, Second Inverse-Transformer 240 may be implemented by circuitry and/or software as is known in the art. Second Inverse-Transformer 240 may be fully implemented in software running on a general or special purpose digital computer.

In preferred embodiments, as is known in the art, the receiving means of Second Inverse-Transformer 240 accepts transformed-source-identified-frames, and associated identification information, from Assembler 230 and makes them available for further processing by Second Inverse-Transformer 240.

In preferred embodiments, as is known in the art, the inverse-transforming means of Second Inverse-Transformer 240 applies an inverse data transformation operation to the transformed-source-identified-frames. The application of the inverse data transformation operation to one or more transformed-source-identified-frames results in the production of a source-identified-frame. Based on the identification information associated with the transformed-source-identified-frames, identification information is associated with the source-identified-frames.

In preferred embodiments, the selection of the inverse data transformation operation is based, as is known in the art, on the first transformation operation that was performed on the source-identified-frame on the compression side. Note that, based on the first transformation operation that was performed on the compression side, multiple transformed-source-identified-frames may be transformed together to form a single source-identified-frame. The identification information is used, as is known in the art, to identify the transformed-source-identified-frames that are transformed together.

In the continuing example and in a preferred embodiment, Second Inverse-Transformer 240 employs, as is known in the art, an inverse LPC transform. If a preemphasis filter was employed on the compression side to condition the data prior to conducting the LPC transform, then a corresponding deemphasis filter should also be applied to the output of the inverse LPC transform, as is known in the art.

As discussed previously in reference to the First Transformer on the compression side, in a preferred embodiment of the compression side, each transformed-source-identified-frame containing vocal-tract parameters expressed as line spectra is processed by subtracting a precalculated set of line spectra values from the line spectra values of the transformed-source-identified-frame's line spectra. When this subtraction has occurred on the compression side, it is necessary to add, on the decompression side, the same precalculated set of line spectra values to the line spectra values of each transformed-source-identified-frame containing vocal-tract parameters expressed as line spectra.

Postprocessor

In the preferred embodiment depicted in FIG. 2, Decompression-side Postprocessor 250 is in communication with Second Inverse-Transformer 240 and Data Channels 270, and has means for receiving at least one source-identified-frame from Second Inverse-Transformer 240 and means, responsive to at least one source-identified-frame, for combining at least one source-identified-frame into at least one of Data Channels 270.

In preferred embodiments, Decompression-side Postprocessor 250 may be implemented by circuitry andlor software as is known in the art. Decompression-side Postprocessor 250 may be fully implemented in software running on a general or special purpose digital computer.

In preferred embodiments, as is known in the art, the receiving means of Decompression-side Postprocessor 250 accepts source-identified-frames, and associated identification information, from Second Inverse-Transformer 240 and makes them available for further processing by Decompression-side Postprocessor 250.

In preferred embodiments, as is known in the art, the combining means of Decompression-side Postprocessor 250 performs a combining operation, employing the identification information associated with each source-identified-frame to exactly or approximately reconstruct the ordered set of digital data elements that were transported by each of Data Channels 170, and makes the ordered sets of digital data elements available for transport by Data Channels 270.

In the continuing example and in a preferred embodiment, each of the plurality of Data Channels 270 is a telephone-type voice grade data channel as is provided by telephone system central offices; each of the plurality of Data Channels 270 carries digitized telephone system voice communications; and, as is known in the art, Decompression-side Postprocessor 250 contains the circuitry and software required to interface to such telephone data channels.

Method for Processing Data from Multiple Channels (Compression-side)

Figure 3:
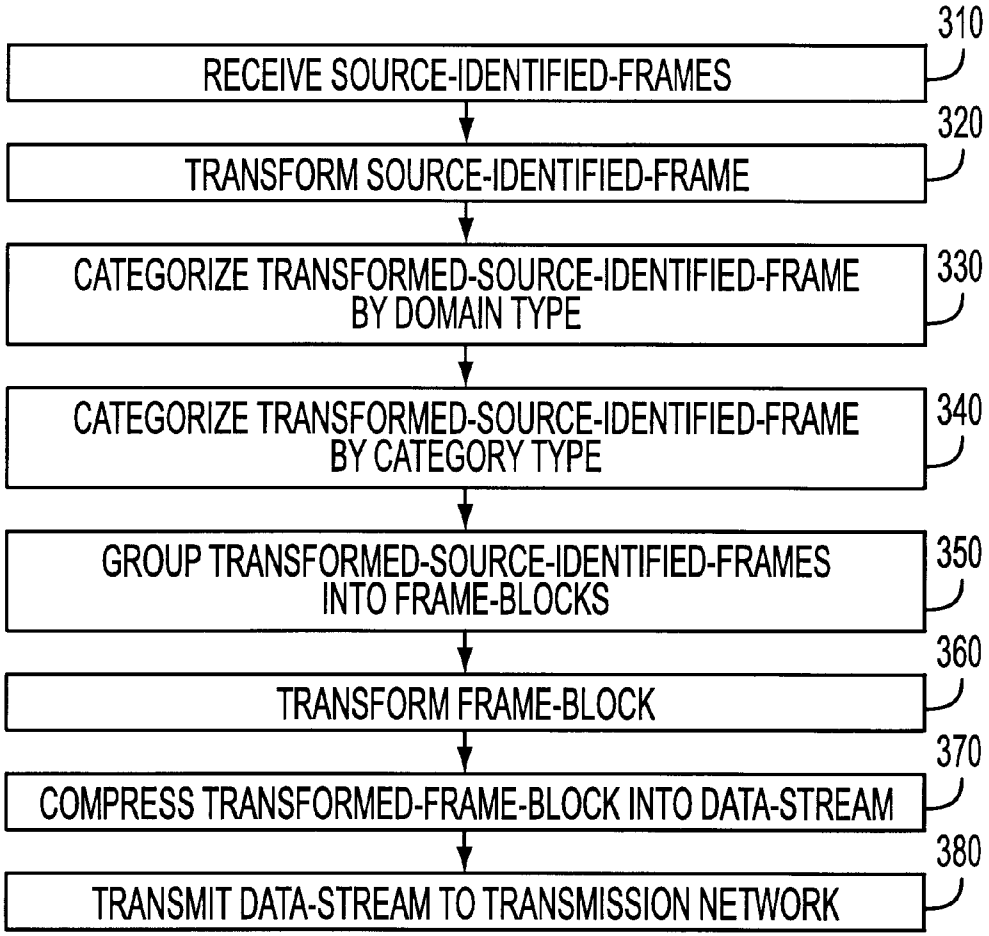
FIG. 3 is a flow chart depicting a preferred embodiment of a method of the present invention for processing data from multiple channels.

FIG. 3 depicts a flow chart of a preferred embodiment of a method for processing data from multiple channels. The method includes the steps of receiving a plurality of source-identified-frames; transforming at least one source-identified-frame into at least one transformed-source-identified-frame; categorizing at least one transformed-source-identified-frame by domain type wherein there is at least one prespecified domain type; categorizing at least one transformed-source-identified-frame by category type wherein there is at least one prespecified category type; grouping at least one transformed-source-identified-frame into at least one frame-block in response to the domain type and the category type of at least one transformed-source-identified-frame; transforming at least one frame-block into at least one transformed-frame-block; compressing at least one transformed-frame-block into at least one data-stream; and transmitting at least one data-stream to a transmission network.

In the preferred embodiment depicted in FIG. 3, the step of receiving a plurality of source-identified-frames step is accomplished by Receive Source-Identified-Frames step 310. As discussed in reference to FIG. 1, First Transformer 110, which is in communication with Compression-side Preprocessor 160, would receive source-identified-frames from Compression-side Preprocessor 160 using techniques that are known in the art.

In the preferred embodiment depicted in FIG. 3, the step of transforming at least one source-identified-frame into at least one transformed-source-identified-frame step is accomplished by Transform Source-Identified-Frame step 320. As discussed in reference to FIG. 1, First Transformer 110 would apply a data transformation operation to the source-identified-frames. The result of this data transformation operation is to produce one or more transformed-source-identified-frames from each source-identified-frame. In a preferred embodiment depicted in FIG. 3, the source-identified-frames include speech-type data, and Transform Source-Identified-Frame step 320 includes the step of converting at least one source-identified-frame into at least one transformed-source-identified-frame having a first domain type related to vocal-tract parameters and at least one transformed-source-identified-frame having a second domain type related to residual excitation signals. In a preferred embodiment, transformed-source-identified-frames having a first domain type related to vocal-tract parameters include line spectra that further include at least one line-spectra-value.

In the preferred embodiment depicted in FIG. 3, the step of categorizing at least one transformed-source-identified-frame by domain type wherein there is at least one prespecified domain type is accomplished by Categorize Transformed-Source-Identified-Frame By Domain Type step 330. As discussed in more detail in reference to FIG. 1, Classifier 120 would assign a domain type, as is known in the art, to each transformed-source-identified-frame. In a preferred embodiment and as discussed in reference to FIG. 1, use of the LPC transform results in a first domain type related to vocal-tract parameters and a second domain type related to residual excitation signals.

In the preferred embodiment depicted in FIG. 3, the step of categorizing at least one transformed-source-identified-frame by category type wherein there is at least one prespecified category type is accomplished by Categorize Transformed-Source-Identified-Frame By Category Type step 340. As discussed in more detail in reference to FIG. 1, Classifier 120 would assign a category type, as is known in the art, to each transformed-source-identified-frame. In a preferred embodiment depicted in FIG. 3, at least one category type relates to fully-silent-type transformed-source-identified-frames, at least one category type relates to voiced-type transformed-source-identified-frames, and at least one category type relates to unvoiced-type transformed-source-identified-frames. In an alternative preferred embodiment depicted in FIG. 3, at least one category type relates to fully-silent-type transformed-source-identified-frames, at least one category type relates to quiet-type transformed-source-identified-frames, at least one category type relates to voiced-type transformed-source-identified-frames, at least one category type relates to unvoiced-type transformed-source-identified-frames, and at least one category type relates to transitional-type transformed-source-identified-frames.

In the preferred embodiment depicted in FIG. 3, the step of grouping at least one transformed-source-identified-frame into at least one frame-block, in response to the domain type and the category type of at least one transformed-source-identified-frame, is accomplished by Group Transformed-Source-Identified-Frames Into Frame-Blocks step 350. As discussed in more detail in reference to FIG. 1, Classifier 120 would group transformed-source-identified-frames into frame-blocks such that transformed-source-identified-frames having identical domain and category types are grouped in the same frame-blocks.

In a preferred embodiment depicted in FIG. 3, Group Transformed-Source-Identified-Frames Into Frame-Blocks step 350 includes the step of arranging the transformed-source-identified-frames grouped into frame-blocks.

In a preferred embodiment, the arranging step includes the step of averaging the line-spectra-values of each transformed-source-identified-frames that includes line spectra and that is grouped into a frame-block, and the arranging step is responsive to this averaging step.

In an alternative preferred embodiment, the arranging step includes the step of selecting, in accordance with predefined criteria, a subset of the line-spectra-values of each transformed-source-identified-frame that includes line spectra and that is grouped into at least one frame-block; and the step of averaging the subset of the line-spectra-values; and the arranging step is responsive to this averaging step.

In an alternative preferred embodiment, the arranging step includes the step of associating an average-frame-energy with each transformed-source-identified-frame that is grouped into at least one frame-block, and the arranging step is responsive to this average-frame-energy associating step. In a further alternative preferred embodiment, this average-frame-energy associating step is responsive to an average-frame-energy of each transformed-source-identified-frame having a second domain type related to residual excitation signals and that is grouped into at least one frame-block.

In an alternative preferred embodiment, the arranging step includes the step of associating an average-frame-energy with each source-identified-frame, and the arranging step is responsive to this average-frame-energy associating step.

In an alternative preferred embodiment, the arranging step includes the step of associating an zero-crossing-rate with each transformed-source-identified-frame having a second domain type related to residual excitation signals and that is grouped into at least one frame-block, and the arranging step is responsive to this zero-crossing-rate associating step.

In an alternative preferred embodiment, the arranging step includes the step of associating a zero-crossing-rate with each source-identified-frame, and the arranging step is responsive to this zero-crossing-rate associating step.

Arranging, selecting, and averaging techniques are discussed in more detail in reference to Classifier 120 as depicted in FIG. 1.

In the preferred embodiment depicted in FIG. 3, the step of transforming at least one frame-block into at least one transformed-frame-block step is accomplished by Transform Frame-Block step 360. As discussed in reference to FIG. 1, Second Transformer 130 would apply a data transformation operation to the frame-blocks. The result of this data transformation operation is to produce a transformed-frame-block from each frame-block. In a preferred embodiment depicted in FIG. 3, the frame-block transforming step includes a forward two-dimensional transform. In a further preferred embodiment, the forward two-dimensional transform includes a transform selected from a group of transforms including the Fourier transform, the Fast Fourier transform, wavelet transforms, DST transforms, a DCT transforms, a Haar transform, a Walsh transform, and a KLT transform. Two-dimensional transforms are described in detail in reference to Second Transformer 130.

In the preferred embodiment depicted in FIG. 3, the step of compressing at least one transformed-frame-block into at least one data-stream is accomplished by Compress Transformed-Frame-Block Into Data-Stream step 370. As discussed in reference to FIG. 1, Compression-side Postprocessor 140 would apply quantization, scaling, and coding operations to the transformed-frame-blocks. The result of these operations is to produce a data-stream from each transformed-frame-block. In a preferred embodiment, the compressing step includes the step of converting at least one transformed-frame-block to a differential representation. Differential representations are described in detail in reference to Compression-side Postprocessor 140.

In the preferred embodiment depicted in FIG. 3, the step of transmitting at least one data-stream to a transmission network step is accomplished by Transmit Data-Stream To Transmission Network step 380. As discussed in reference to FIG. 1, Compression-side Postprocessor 140 is in communication with Transmission Network 150. Compression-side Postprocessor 140 would transmit data-streams to Transmission Network 150 as is known in the art.

Figure 5:
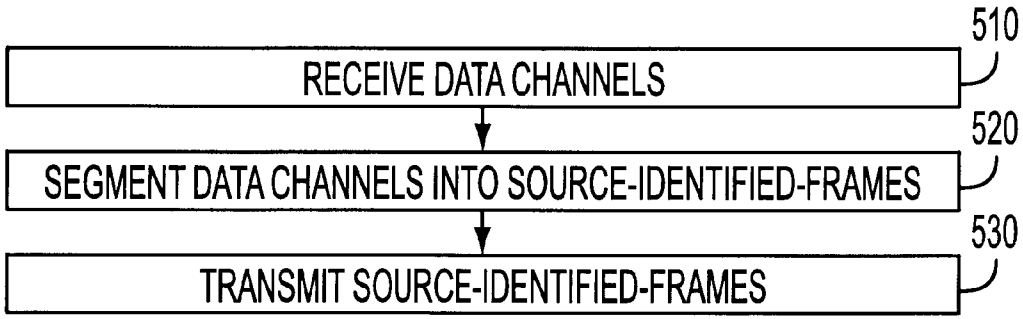
FIG. 5 is a flow chart depicting a preferred embodiment of a segmenting method of a method of the present invention for processing data from multiple channels.

In a preferred embodiment that is depicted in FIG. 5, the method for processing data from multiple channels would further include the steps of receiving a plurality of data channels, segmenting at least one data channel into a plurality of source-identified-frames, and transmitting the plurality of source-identified-frames.

In the preferred embodiment depicted in FIG. 5, the step of receiving a plurality of data channels step is accomplished by Receive Data Channels step 510. As discussed in more detail in reference to FIG. 1, Compression-side Preprocessor 160, which is in communication with Data Channels 170, would receive data channels from Data Channels 170 using techniques that are known in the art.

In the preferred embodiment depicted in FIG. 5, the step of segmenting at least one data channel into a plurality of source-identified-frames would be accomplished by Segment Data Channel Into Source-Identified-Frames step 520. As discussed in more detail in reference to FIG. 1, Compression-side Preprocessor 160 would apply a segmenting operation to the received data channels. The result of this segmenting operation is the production of source-identified-frames.

In the preferred embodiment depicted in FIG. 5, the step of transmitting the plurality of source-identified-frames is accomplished by Transmit Source-Identified-Frames step 530. As discussed in more detail in reference to FIG. 1, Compression-side Preprocessor 160, which is in communication with First Transformer 110 would transmit source-identified-frames to First Transformer 110 using techniques that are known in the art.

Method for Processing Data for Multiple Channels (Decompression-side)

Figure 4:
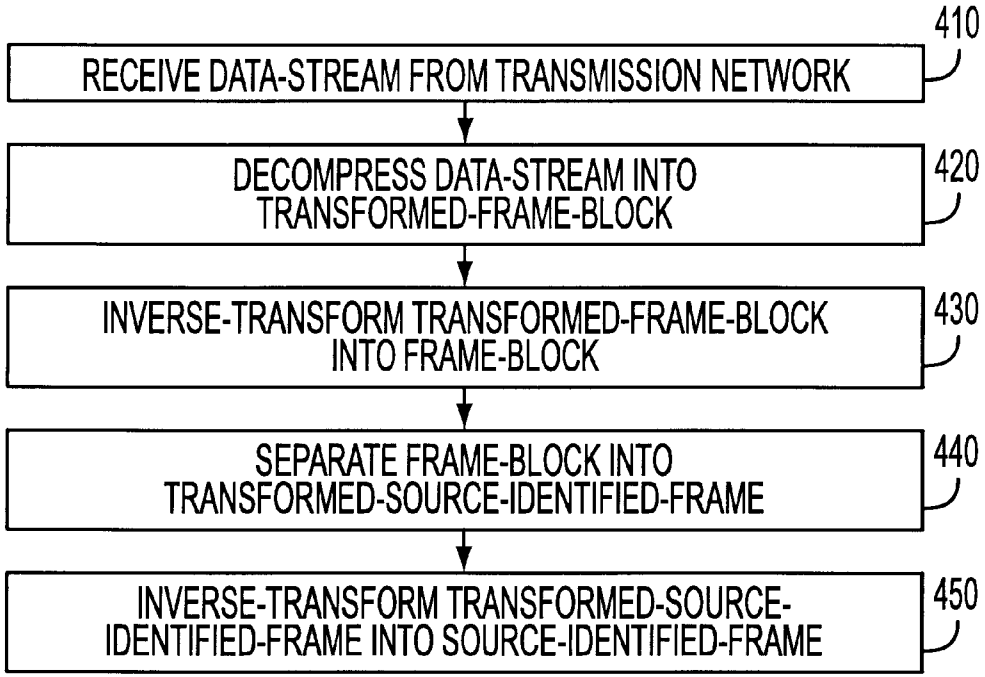
FIG. 4 is a flow chart depicting a preferred embodiment of a method of the present invention for processing data for multiple channels.

FIG. 4 depicts a flow chart of a preferred embodiment of a method for processing claims for multiple channels. The method includes the steps of receiving at least one data-stream from a transmission network, decompressing at least one data-stream into at least one transformed-frame-block, inverse-transforming at least one transformed-frame-block into at least one frame-block, separating at least one frame-block into at least one transformed-source-identified-frame, and inverse-transforming at least one transformed-source-identified-frame into at least one source-identified-frame.

In the preferred embodiment depicted in FIG. 4, the step of receiving at least one data-stream from a transmission network is accomplished by Receive Data-Stream From Transmission Network step 410. As discussed in reference to FIG. 2, Decompression-side Preprocessor 210, which is in communication with Transmission Network 150, would receive data-streams from Transmission Network 150 using techniques that are known in the art.

In the preferred embodiment depicted in FIG. 4, the step of decompressing at least one data-stream into at least one transformed-frame-block is accomplished by Decompress Data-Stream Into Transformed-Frame-Block step 420. As discussed in reference to FIG. 2, Decompression-side Preprocessor 210 would apply a decompression operation to the data-streams. The result of this decompression operation is to produce one or more transformed-frame-blocks from each data-stream. As discussed in more detail in reference to Decompression-side Preprocessor 210, the particular decompression operation is selected with reference to the compression operation used to create the data-streams.

In the preferred embodiment depicted in FIG. 4, the step of inverse-transforming at least one transformed-frame-block into at least one frame-block is accomplished by Inverse-Transform Transformed-Frame-Block Into Frame-Block step 430. As discussed in reference to FIG. 2, First Inverse-Transformer 220 would apply an inverse-transformation operation to the transformed-frame-blocks. The result of this inverse-transformation operation is to produce a frame-block from each transformed-frame-block. As discussed in more detail in reference to First Inverse-Transformer 220, the particular inverse-transformation operation is selected with reference to the second transformation operation used to create the transformed-frame-blocks. In a preferred embodiment, the transformed-frame-block inverse-transforming step includes an inverse two-dimensional transform. In a further preferred embodiment, the inverse two-dimensional transform includes a transform selected from a group of transforms including the Fourier transform, the Fast Fourier transform, wavelet transforms, DST transforms, a DCT transform, a Haar transform, a Walsh transform, and a KLT transform. Two-dimensional transforms are described in reference to First Inverse-Transformer 220.

In the preferred embodiment depicted in FIG. 4, the step of separating at least one frame-block into at least one transformed-source-identified-frame is accomplished by Separate Frame-Block Into Transformed-Source-Identified-Frame step 440. As discussed in reference to FIG. 2, Assembler 230 would apply a separating operation to the frame-blocks. The result of this separating operation is to produce transformed-source-identified-frames from each frame-block. As discussed in more detail in reference to Assembler 230, transformed-source-identified-frames used for padding would be discarded.

In the preferred embodiment depicted in FIG. 4, the step of inverse-transforming at least one transformed-source-identified-frame into at least one source-identified-frame step is accomplished by Inverse-Transform Transformed- Source-Identified-Frame Into Source-Identified-Frame step 450. As discussed in reference to FIG. 2, Second Inverse-Transformer 240 would apply an inverse-transformation operation to the transformed-source-identified-frames. The result of this inverse-transformation operation is to produce a source-identified-frame from one or more transformed-source-identified-frames. As discussed in more detail in reference to Second Inverse-Transformer 240, the particular inverse transformation operation is selected with reference to the first transformation operation used to create the transformed-source-identified-frames. In a preferred embodiment, the transformed-source-identified-frame inverse-transforming step includes an inverse LPC transform. Inverse LPC transforms are described in reference to Second Inverse-Transformer 240.

Figure 6:
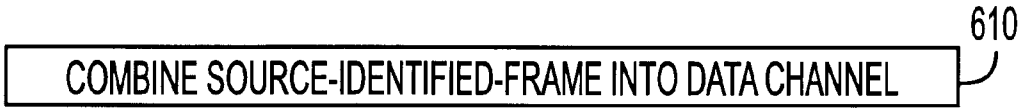
FIG. 6 is a flow chart depicting a preferred embodiment of a combining method of a method of the present invention for processing data for multiple channels.

In a preferred embodiment that is depicted in FIG. 6, the method for processing data for multiple channels would further include the step of combining, responsive to at least one source-identified-frame, at least one source-identified-frame into at least one data channel.

In the preferred embodiment depicted in FIG. 6, the step of combining, responsive to at least one source-identified-frame, at least one source-identified-frame into at least one data channel, is accomplished by Combine Source-Identified-Frame Into Data Channel step 610. As discussed in more detail in reference to FIG. 2, Decompression-side Postprocessor 250, which is in communication with Data Channels 270, would apply a combining operation on the source-identified-frames. The result of the combining operation is to exactly or approximately reconstruct the ordered set of digital data elements that had been transported by each of Data Channels 170 and make them available for further transport by each of Data Channels 270.

A Comprehensive Example

This section provides a detailed description of a preferred embodiment of the current invention, as depicted in FIGS. 1 and 2. In the following description, frequent references to arrays of data are made. For example, a one-dimensional array of 160 samples, referred to as "signal," will be denoted as signal[i] with i being the index identifying the with sample. A zero-based indexing convention is employed, meaning that i ranges between 0 and 159, inclusive, for a signal array of 160 samples. The notation <array name>[nnn] means, depending upon context, the nnn-th element of <array name> or that <array name> is an array of nnn elements.

Similar references are used for two-dimensional arrays. For example, with a 2D-array having 120×160 elements, the notation <array name>[i][j] refers to the jth element in the ith row; employing the zero-based indexing convention, j ranges [0 . . . 159], and i ranges [0 . . . 119]. As above, the notation <array name>[nnn1][nnn2] means, depending upon context, the nnn2-th element in row nnn1 of <array name>, or that <array name> is an array of nnn1 rows of nnn2 elements per row.

When an array is referenced regardless of index value(s), <array name>[ ] and <array name>[ ][ ] refer to the respective one-dimensional (vector) and two-dimensional (matrix) arrays. Notations such as signal [0 . . . 40], or buffer [chan][40 . . . 199] refer to ranges of data ("chan" is frequently used to denote one channel of Data Channels 170, with buffer[chan][ ]referring to a particular vector of matrix buffer that contains data related to one channel of Data Channels 170). A notation such as buffer[0 . . . 119][0 . . . 199] may also be used to denote the size of an array.

An expression such as output[chan][ ]=my_function (array[chan][ ], value); means that the function my_function operates on a particular channel vector (chan) of matrix array and on the scalar value, with the result being stored in a particular channel vector (chan) of matrix output.

Compression System

Compression-side Preprocessor

As depicted in FIG. 1, Compression-side Preprocessor 160 receives incoming data from Data Channels 170. In a preferred embodiment, incoming data is already sampled and digitized when it is received by Compression-side Preprocessor 160. In an alternative preferred embodiment, Compression-side Preprocessor 160 incorporates an analog-to-digital (A/D) front-end in which each analog telephone data from each channel of Data Channels 170 is sampled and digitized. In this preferred embodiment, each channel of Data Channels 170 conforms to typical telephony standards, i.e., 8000 samples/second per voice channel, approximately 0.3–3.3 kHz input signal bandwidth, and u-Law or A-law encoded samples (which may, in some embodiments, be converted to linearly-encoded values typically ranging from −32768 to +32767), in 8-bit samples (providing 64 kbps input) or 7-bit samples (using "robbed-bit" signaling, as is known in the art where the external telephone system uses the least significant bit for auxiliary data transfer).

Compression-side Preprocessor 160 contains a two-dimensional input buffer input[0 . . . 119][0 . . . 199] that is designed to simultaneously hold data from up to 120 channels of Data Channels 170. Thus, the particular channels with data stored in the input buffer at any one time form a particular supergroup. Multiple supergroups, i.e. when the total number of channels of Data Channels 170 is greater than 120, are processed sequentially in a preferred embodiment. The data loaded into the input buffer is processed by the system of the present invention as a unit referred to in previous sections of this Specification as a collection. Collections of channels are processed independently of each other, and no interdependencies or data relationships across collections are established. In a preferred embodiment, both a particular collection and a particular supergroup may hold less than 120 channels.

In a preferred embodiment, if a channel of Data Channels 170 becomes inactive, i.e. the telephone connection is broken due to hangup, disconnection, or other possible termination, Compression-side Preprocessor 160 does not allow data from that channel to be presented to the input buffer. Inactive channels should be distinguished from channels where a connection is present even though the channel may transmit silence from time to time, for example, during pauses in a conversation. Active channels that are temporarily silent will continue to be presented to the input buffer. As is known in the art, in a preferred embodiment, information about channel state, supergroup identification, and assignments of channels within supergroups are transmitted, monitored, and controlled through an "SS7" type data stream. A channel that has been disconnected frees a vector in input for a particular supergroup, and this vector is available for use by another channel. In this description, subsequent use of the phrase "for each channel" means for each open, active channel—i.e., in a preferred embodiment, a system that is only processing 60 active channels will not be working on "dead data" for the remaining 60 (=120−60) channels but only on the active channels.

As defined above, input holds 200 samples of data from each channel. A channel that becomes inactive (hangs up, disconnects, etc.) while loading input has the remainder of the data values of its vector in input set to zero. In this embodiment, each vector in input holds 20 milliseconds of new data from a channel. At the data rate of 8000 samples per second per channel, a total of 160 data samples per channel per 20 milliseconds is available for loading into input. But, as described above, each vector in input is capable of holding 200 data samples and it is necessary to pad each vector with additional data to provide the additional 40 data samples.

This embodiment uses the LPC transform, and it is beneficial in this embodiment to use an LPC analysis window of approximately 25 milliseconds. With the data rate of 8000 samples per second per channel, 25 milliseconds would provide 200 samples. It is otherwise desirable, however, to fill input with only 20 milliseconds of new data from each channel (160 data samples). Thus the need to pad the vectors in input.

Compression-side Preprocessor 160 initiates the processing of a particular collection of channels by converting each of the channels in the collection from their encoded states, as received by Compression-side Preprocessor 160 from Data Channels 170, into a set of linearly-encoded values, typically ranging, in this preferred embodiment, from −32768 to +32767. These linearly-encoded values are loaded, as just described, into input with data from a particular channel occupying a particular row (vector) in the matrix input Compression-side Preprocessor 160 uniquely identifies each supergroup and the assignment of channels from Data Channels 170 to particular vectors within matrix input, as is known in the art. For example, input[5][ ] of supergroup 1 holds data from the 6th physical channel of Data Channels 170 while input[5][ ] of supergroup 2 holds data from the 126th physical channel 126 of Data Channels 170. Due to this traceability, which is maintained throughout compression-side processing, individual vectors (or rows) in input are source-identified-frames, using the terminology developed in previous sections of this Specification.

In this embodiment, new data from each channel is placed in the last 160 elements of that channers vector in input so that input[chan][40 . . . 199] contains each channel's new input data. At channel start-up, such as at the beginning of a telephone call, the first 40 elements of that channel's vector in input are populated with zero values. Subsequently, when that channel's vector in input is loaded, the last 40 data samples from that channel, which have already been processed, are copied into the first 40 elements of that channel's vector (input[chan][0 . . . 39]) and new data from that channel is copied into the last 160 elements of the vector (input[chan][40 . . . 199]). Thus, although each supergroup represents a time slice of 20 ms from each channel that it carries, the LPC analysis operates on a contiguous vector of 25 ms of digitized speech.

Schematically (one row of input):

First load (40 zeroes, first 160 samples):

Channel #N: [0,0,0 . . . , 0,0,0, sample0, sample1, sample 2, . . . sample159];

Next load (40 latest previous samples, 160 new samples):

Channel #N: [sample120, sample121, . . . sample159, sample160, sample161, . . . sample319]; In an alternative preferred embodiment, this method of padding may be used to further expand the analysis window to 240 samples per 30 milliseconds per channel while still only 160 samples of new data are loaded into each channel vector.

Initial LPC Processing

In this preferred embodiment, LPC processing is performed by First Transformer 110 which receives source-identified-frames from Compression-side Preprocessor 160 in the form of vectors contained in the matrix input. As described above, LPC processing is done once per 25 millisecond analysis window, based on 20 millisecond collection updating cycles. As described below, $10^{th}$ -order LPC analysis is performed as is known in the art. In this embodiment, all of the analysis steps described below are performed in sequence for a particular channel before any of the analysis steps is applied to the next channel. Similarly in this embodiment, all channels of a collection are processed before any channels of another collection are processed.

New data structures are created during this LPC processing that are also used by Classifier 120. The arrays lsf_prev, pc_prev, and preemph_sav save prior state history. The array lsf_prev[0 . . . 119][0 . . . 9] contains 10-element line spectral frequency (LSF) vectors calculated from the previous source-identified-frame for each channel. The array pc_prev[0 . . . 119][0 . . . 9] contains 10-element bandwidth-expanded LPC direct-form coefficients calculated from the previous source-identified-frame for each channel. The array preemph_sav[0 . . . 119] contains a one element $1^{st}$ order preemphasis filter state calculated from the application of this preemphasis filter to the previous source-identified-frame for each channel.

Additional data structures are a frame class matrix, class [0. . . 119][0 . . . 4], and a matrix origclass[0 . . . 119][0 . . . 4] used to smooth categorization decisions. The element class[chan][4] contains the smoothed speech categorization state, as described below, of the current source-identified-frame of a channel, with four previous states for each channel being stored in class[chan][0 . . . 3]. The array origclass[0 . . . 119][0 . . . 4] is similar to class in structure and function, but contains original, unsmoothed basic frame categorizations. In a preferred embodiment, the class and origclass arrays operate in a shift register, last-in/first-out manner, as is known in the art, in which each new entry for a particular channel pushes the prior entries for that channel down and the oldest entry for that channel is discarded.

The frame categorization process may not always properly categorize a particular frame. To avoid transition artifacts caused by improper frame classification, a smoothing operation may be performed to recategorize a frame. In a preferred embodiment, a frame from a particular channel that has an original categorization other than voiced is recategorized (smoothed) to the voiced category if and only if the last four original frame categorizations for that channel were all voiced categorizations. Thus, origclass is used to support the smoothing operation, while class stores the smoothed categorization decisions and is used for later grouping. In this embodiment, the following codes are used for categorizations: 0=silence, 1=voiced, 2=unvoiced. Also in this embodiment, value of −1 is temporarily stored in both arrays to flag non-silence and indicate that further categorization of the frame is required.

Arrays lsf_prev, pc_prev, preemph, class, and origclass are initialized for a particular channel when that channel starts up, and are used for smoothing and averaging parameters between frames to avoid abrupt transitions that could cause audible distortion.

LPC processing by First Transformer 110 in order to derive line spectra from each source-identified-frame, is briefly summarized as follows:

a) Source-identified-frames from input are checked to determine if they contain silence. If the absolute value of 80% of the samples in the 160 new data sample portion of the source-identified-frame (not the entire 200 data sample source-identified-frame) is less than or equal to 40, and the maximum absolute value of any sample is less than 96, then the frame is classified as silent. Elements class[chan][4] and origclass[chan][4] are set to −1 if the source-identified-frame is not classified as silent to indicate that further classification processing will be conducted. A silent source-identified-frame ends all further processing for that frame—the vectors rc[chan][ ] and lsf[chan][ ] are set to all zeroes, and processing continues for other channels.

b) Non-silent source-identified-frames are preemphasized with a simple $1^{st}$-order difference filter (a=0.9375) and stored in the two-dimensional array preemph[0 . . . 119][0 . . . 199]. Later processing (LPC inverse filtering to obtain the residual excitation signal) will operate on the 160 element new data sample that has been preemphasized and which is stored for each channel chan in preemph[chan][40 . . . 199].

c) A 200-point Hamming window is applied to each preemphasized channel vector, preemph[chan][0 . . . 199], and stored in two dimensional array work[0 . . .119][0 . . . 199].

d) An 11-lag (including lag=0) non-normalized autocorrelation is applied to each channel vector in work. The autocorrelation data is placed in two-dimensional array acf[0 . . . 119][0 . . . 10].

e) If acf[chan][0]<0.0, then subsequent LPC processing for that channel is ended since the channel can be considered to be silent or not amenable to processing. If processing is aborted, the vectors rc[chan][ ] and lsf[chan][ ] are set to all zeros for that channel, and processing continues for other channels.

f) For each channel where processing has not been ended, an 11-point 80 Hz Binomial Window is applied, in place, to each channel's autocorrelation data in acf. This assists in smoothing the LPC spectrum. As is known in the art, each acf[ ][n] term is multiplied, in place, by the respective B[n] term. The Binomial Window coefficients B[n] for an 8 kHz sample rate are determined by the relations:

$$K=(-\ln 2)/(2\times\ln(\cos((pi/2)\times(width/Fs))))$$

where width=Hertz (set to 80 Hz here), and Fs=8000 (8 kHz sampling rate);

$$B[0]=b=1.0;$$

for n=0 to 9: {b=b×(K−n)/(K+n+1); B[n]=b;}

In this embodiment, the 11 -element Binomial Window array, B[0 . . . 10] is thus:

[1.000, 0.999644141308, 0.998577324773, 0.996801826321, 0.994321430172, 0.991141415401, 0.987268537220, 0.982711003071, 0.977478443646, 0.971581878984, 0.965033679805];

g) The modified autocorrelation data in acf resulting from f) above is used as an input to Schur's recursion, as is known in the art, which generates 10 reflection coefficients from 11 autocorrelation coefficients for each channel. These reflection coefficients are stored in two dimensional array rc[0 . . . 119][0 . . . 9]. The residual energy from each channel's reflection coefficients vector is calculated and stored in a one-dimensional array resid_energy[0 . . . 119] as follows:

$$resid_energy[chan] = acf[chan][0]\cdot\prod_{k=0}^{9}(1.0-(rc[chan][k])^2)$$

h) The autocorrelation values are corrected for high-frequency behavior. Each channel's autocorrelation vector is adjusted using the residual energy computed above:

$$acf[\text{chan}][0]=acf[\text{chan}][0]+\lambda\cdot\mu 0\cdot\text{resid_energy}[\text{chan}];$$

$$acf[\text{chan}][1]=acf[\text{chan}][1]+\lambda\cdot\mu 1\cdot\text{resid_energy}[\text{chan}];$$

$$acf[\text{chan}][2]=acf[\text{chan}][2]+\lambda\cdot\mu 2\cdot\text{resid_energy}[\text{chan}];$$

where, in this embodiment, the correction vector $\mu i$=[0.375, 0.250, 0.625] and the scaling value $\lambda$=0.01.

i) The high frequency-corrected autocorrelation values produced by h) above are then again processed by Schur's recursion to obtain a second, set of reflection coefficients which is stored in rc (For $10^{th}$ order LPC analysis, 10 reflection coefficients are obtained from 11 autocorrelation coefficients for each channel).

j) The reflection coefficients produced in i) above are converted in-place to LPC direct-form predictor coefficients and are bandwidth expanded by 15 Hz. These LPC predictors are converted back to reflection coefficients in the two-dimensional array temp[0 . . . 119][0 . . . 9] and each reflection coefficient is examined for stability, i.e., if −1.0<rc[ ][ ]<1.0. If the reflection coefficients for a given channel are stable, then the corresponding previously calculated bandwidth-expanded predictor coefficients are used, i.e. the current contents of rc[chan][ ] remain the same; otherwise, the predictor coefficient vector for that channel which has been previously stored in pcprev is copied from pcprev [chan][0 . . . 9] into rc[chan][0 . . . 9].

k) The bandwidth-expanded predictor coefficients from rc are saved to pcprev.

l) As is known in the art, 10-element line spectra (LSF) vectors are calculated for each channel and stored in lsf[chan][0 . . . 9]. If an unstable LSF conversion occurs for a given channel, the previous LSF vector, contained in lsf_prev[chan][ ], for that channel is copied to that channel's current LSF vector in lsf[chan][ ].

After the LSF vectors are calculated as described, the channel vectors in array lsf are, using the terminology developed in previous sections of this Specification, transformed-source-identified-frames containing line spectra.

LPC Residual Generation

In this example, First Transformer 110 generates LPC residuals using some of the information calculated while generating line spectra. The major data structures used for LPC Residual Generation are the two-dimensional array filtmem[0 . . . 119][0 . . . 10] that stores the analysis filter history in order to maintain the filter state through each filter operation per channel, and the two-dimensional array resid[0 . . . 119][0 . . . 159] that stores residuals for each channel. When a channel undergoes start-up or if the prior source-identified-frame for a channel was classified as silent, then that channel's filter state is zeroed, i.e., that channel's vector in filtmem is set to zero. Zeroing a channel's filter state eliminates any extraneous data that may be present in that channel's vector in filtmem on startup or when detection of a silent frame cause processing of the silent frame to be ended. In a preferred embodiment, as mentioned previously, the LPC residual processing is done on data elements derived from the 160 new data elements in source-identified-frames, not from the full 200 data elements used to derive line spectra from the channel vectors.

The process of generating LPC residuals in this embodiment is based on the preemphasized 160 sample elements for each non-silent channel that were stored in preemph[0 . . . 119][40 . . . 199] as described above. Each of these preemphasized channel vectors is "inverse filtered" using the direct-form LPC coefficients derived from smoothed LSF coefficients to generate an LPC residual excitation signal, i.e., the "residual".

In this embodiment, the LPC inverse filter for each channel changes its filter parameters every 5 ms, thus the same filter parameters are used for partial channel vectors containing 40 elements. There are, therefore, 4 partial channel vectors in each channel vector. The filter parameters are derived by forming a weighted sum of the channel's previous LSF vector as stored in lsf_prev[chan][ ] and the current LSF vector for the channel as stored in lsf[chan][ ]. This technique creates smoother, less abrupt changes in the LSF vector. Four new weighted-mix LSF vectors created as described below, lsf0[0 . . . 9], lsf1[0 . . . 9], lsf2[0 . . . 9], lsf3[0 . . . 9], are converted, as described below, to four sets of LPC direct-form prediction coefficient vectors (pc0[0 . . . 9], pc1[0 . . . 9], pc2[0 . . . 9], pc3[0 . . . 9]) that control the LPC inverse filter. However, if the channel's previous LSF vector is zero (i.e., this is the first channel vector of the call, or a silent period occurred previously), then this weighting does not take place.

Thus, for each nonsilent channel:

Partial channel vector 0: lsf0[0 . . . 9]=0.875×lsf_prev [chan][0 . . . 9]+0.125×lsf[chan][0 . . . 9];

Partial channel vector 1: lsf1[0 . . . 9]=0.625×lsf_prev [chan][0 . . . 9]+0.375×lsf[chan][0 . . . 9];

Partial channel vector 2: lsf2[0 . . . 9]=0.375×lsf_prev [chan][0 . . . 9]+0.625×lsf[chan][0 . . . 9];

Partial channel vector 3: lsf3[0 . . . 9]=0.125×lsf_prev [chan][0 . . . 9]+0.875×lsf[chan][0 . . . 9];

As is know in the art, the four weighted LSF vectors, lsf0[ ], lsf1[ ], lsf2[ ], and lsf3[ ] are converted to LPC direct-form predictor coefficient vectors, pc0[ ], pc1[ ], pc2[ ], and pc3[ ], and checked for stability. The previous predictor coefficient vector for a partial channel vector is used in place of the predictor coefficient vector calculated from the weighting operation if the newly calculated predictor coefficient vector is not stable.

Finally, the LPC analysis (inverse) filter is used 4 times, once per each 40-sample partial-channel vector on the active channel vectors contained in array preemph, with a new predictor vector, pc0[ ] through pc3[ ] each time. The LPC analysis thus generates a 160 sample residual that is stored in resid[0 . . . 119][0 . . . 159]. In addition, each channel's filter history is stored in fliltmem, as is know in the art, for use in the residual calculations for subsequent source-identified-frames.

After the residual vectors are calculated as just described, the channel vectors in array resid are, using the terminology developed in previous sections of this Specification, transformed-source-identified-frames containing residual excitation signals.

Categorization

In this embodiment, transformed-source-identified-frames containing residual excitation signals are further categorized by the type of speech data that they represent, i.e., voiced or unvoiced. In this embodiment, transformed-source-identified-frames containing line spectra are not, however, further categorized (they may all be considered to be in a single category). Categorization is performed by Classifier 120, and may be performed on the channel vectors contained in input or on the processed channel vectors contained in resid. In this example, categorization is performed on the channel vectors contained in input (the source-identified-frames). Once the categorizations of the channel vectors contained in input have been determined, then any channel vectors derived from those in input, such as those in resid, will have the same categorizations. Since, in this embodiment, the channel vectors are grouped into a few broad categories, a zero-crossing measure of the center-clipped original speech as captured in input is a good categorization measure. The padded portion of the channel vectors is not used in this measure, so only input[chan][40 . . . 199] is used. Further, only those channel vectors in input not already categorized as silent are processed.

First, each non-silent channel vector from input[chan][40 . . . 199] is center-clipped and stored in cclip[0 . . . 159]. Center-clipping is performed by setting A1 equal to the absolute value of the maximum amplitude contained in the first 50 samples of the non-padded portion of each channel's channel vector in input, and by setting A2 equal to the absolute value of the maximum amplitude in the last 50 samples of the non-padded portion of each channel's channel vector in input A clipping level $C_L$=0.66 (min (A1, A2)) is then set for each channel vector. The center-dipped signal is then generated as follows:

```
for i = 0 to 159{
        x = input[chan][i + 40];
        If (x >= C_L) then cclip[i] = x − C_L
                else
                if (x <= −C_L) then cclip[i] = x + C_L
                else
                cclip[i] =0;
        }
```

Next, the center-clipped signal for a particular channel in cclip is examined for zero-crossing behavior. If the zero-crossing count is less than or equal to 1000 per second, which resolves to a total of 20 crossings per channel vector, then the channel vector categorization is stored as 'voiced' (V) in origclass[chan][0]. If the zero-crossing count is greater than a total of 20 crossings per channel vector, then the channel vector categorization is stored as 'unvoiced' (UV) in origclass[chan][0].

Before new categorizations are stored in origclass[chan][0], and in class[chan][0] as discussed below, it is necessary to manipulate elements within origclass and class so that they maintain a record of the recent previous categorizations of channel vectors from each active channel. The most recent categorizations of a channel's channel vector are stored in origclass[chan][0] and class[chan][0], the next most recent categorizations are stored in origclass[chan][1] and class[chan][1], and so forth. To maintain this record, prior to storing the most recent new categorizations in origclass[chan][0] and class[chan][0], the current contents of origclass[chan][4] and class[chan][4] are discarded, the current contents of origclass[chan][3] and class[chan][3] are copied to origclass[chan][4] and class[chan][4]respectively, the current contents of origclass[chan][2] and class[chan][2] are copied to origclass[chan][3] and class[chan][3] respectively, the current contents of origclass[chan][1] and class[chan][1] are copied to origclass[chan][2] and class [chan][2] respectively, and the current contents of origclass

[chan][0] and class[chan][0] are copied to origclass[chan][1] and class[chan][1] respectively, Finally, a "smoothed" frame categorization is determined and stored in class[chan][0]. If the original frame categorization is other than voiced, then the smoothed frame categorization is stored as voiced in class[chan][0] if and only if all of the categorizations stored in origclass[chan][1 . . . 4] are voiced. Otherwise, the smoothed frame categorization is the same as the original frame categorization. Thus, after smoothing, an unvoiced (UV) channel vector would not appear after a series of more than four channel vectors originally categorized as voiced (V). In this example, the frame smoother maintains a state of V for a frame after a first actually categorized UV frame appears so that any remaining voiced information would be appropriately categorized. Voicing onsets, however, which are the actual detection of a voiced frame after the actual detection of one or more other frame categories, are not smoothed since the onset of a voiced period is critical to speech quality.

Grouping

After categorization and LPC residual generation, the LPC residuals in resid[ ][ ] are grouped by category prior to two-dimensional transform processing. Grouping is performed in Classifier 120. In this embodiment, further grouping is not performed on transformed-source-identified-frames containing line spectra, rather, these transformed-source-identified-frames are treated as one large group in array lsf[ ][ ]. These LSF channel vectors are merely copied to another matrix, lsftmp[0 . . . 119][0 . . . 9] after the removal of silent-channel vectors, and otherwise stay in the same order prior to two-dimensional transformation/compression. Array lsftmp, using the terminology developed in previous sections of this Specification, contains transformed-source-identified-frames (channel vectors) and is a Frame-block 125 collecting together all non-silent transformed-source-identified-frames of the line spectra domain type (and are all classified by default into the same category).

Although previously channels were maintained in consistent positions within the various arrays, channel vector positions within lsftmp that otherwise, in this embodiment, would be vacant due to silent channel vectors are filled with the next available channel vector. While the order of non-silent channels within lsftmp is thus maintained, the row index value of a channel vector is no longer a reliable guide to the identification of the channel associated with that channel vector. As is known in the art, however, the channel associated with a particular channel vector in lsftmp can be identified by reference to the classifications stored in class. A count of the total number of (non-silent) channel vectors stored in lsftmp is maintained in the variable lsfcount.

As was also discussed in a previous section, when each channel vector is stored in lsftmp, a "standard" or "nominal" average LSF vector is subtracted from the channel vector prior to storage. Thus, each channel vector is stored in a mean-removed form. In this embodiment, as in the previous section, the nominal vector used is:

$$avg_LSF[10]=\{286,488,889,1241,1577, 1970, 2265, 2757, 3154, 3482\}.$$

For each non-silent category of residuals, V and UV, a temporary two-dimensional array is created. These arrays are restmp1[0 . . . 119][0 . . . 159] and restmp2[0 . . . 119][0 . . . 159], respectively. In a manner similar to that used to populate lsftmp, non-silent channel vectors from resid are copied, in order, to the next available channel vector position in restmp1 and restmp2 depending on the category type of each channel vector. Arrays restmp1 and restmp2, using the terminology developed in previous sections of this Specification, thus contain transformed-source-identified-frames (channel vectors), and are Frame-blocks 125 collecting together all non-silent transformed-source-identified-frames of the residual excitation signal domain type and further grouping the transformed-source-identified-frames by the category types of voiced and unvoiced.

Similar to the operation of lsftmp, channel vector positions within the restmp arrays that would be vacant due to silent channel vectors are filled with the next available channel vector of the appropriate category. While the order of non-silent channels within the restmp arrays is thus maintained, the row index value of a channel vector is no longer a reliable guide to the identification of the channel associated with that channel vector. As is known in the art, however, the channel associated with a particular channel vector in the restmp arrays can be identified by reference to the classifications stored in class. Counts of the total number of (non-silent) channel vectors stored in restmp1 and restmp2 are maintained in the variables count1 and count2, respectively.

The following pseudocode illustrates the grouping process described above:

```
lsfcount = count1 = count2 =0;
for channel = 0 to num_active_channels − 1{
    if (class[channel] ≠ SILENT){
        copy_vector ((lsf[channel][] − avg_LSF[]) → lsftmp[lsfcount][]);
        lsfcount = lsfcount + 1;
        switch(class[channel])  {
            case VOICED:
                copy_vector(resid[channel][] → restmp1[count1][]);
                count1 = count1 + 1;
                break;
            case UNVOICED:
                copy_vector(resid[channel][] → restmp2[count2][]);
                count2 = count2 + 1;
                break;
                }
    }
}
```

Two-Dimensional Transform Processing

Frame-blocks 125, which in this embodiment are arrays lsftmp, restmp1, and restmp2, are transformed into transformed-frame-blocks by Second Transformer 130. As is known in the art, an lsfcount-deep×10 in-place 2-D dyadic wavelet transform is applied to array lsftmp. Similarly, count1-deep×160 and count2-deep in-place 2-D dyadic wavelet transforms are applied to the arrays restmp1 and restmp2, respectively. In this embodiment, a three level dyadic two-dimensional Daubechies "D4" forward wavelet transform is used, as is known in the art.

Quantization, Arrangement, Coding and Bitstream Output

The two-dimensional transformation performed by Second Transformer 130 above converts arrays lsftmp, restmp1 and restmp2 from frame-blocks to transformed-frame-blocks. These transformed-frame-blocks are quantized, compressed, and transmitted to Transmission Network 150 by Compression-side Postprocessor 140.

As described above, a list of channel categorizations for collection being processed is stored in class[0 . . . 95], transformed LSF channel vectors are stored in lsftmp, and grouped and transformed residual channel vectors are stored in the restmp arrays. The portion of the two-dimensional lsftmp and restmp arrays holding the transformed channel vectors is referred to here as the "active portion" of these arrays. Each active portion of each of these arrays may be considered to be a two-dimensional matrix, as is known in the art, and are referred to herein as the lsftmp matrix, the restmp1 matrix, and the restmp2 matrix. The individual matrix elements on the upper, lower, left, and right edges of each of these matrixes are referred to herein as the "border elements" of the matrix, while all other individual matrix elements of each of these matrixes are referred to herein as "interior elements" of the matrix. The following quantization operations are performed in this embodiment on the lsftmp and restmp arrays:

a) If the number of channel vectors within the lsftmp matrix is less than or equal to 6 (as indicated by lsfcount), then: i) the border elements are examined and the 25% of the border elements having the highest numerical values are left unchanged while all other border elements are set to zero; and ii) the interior elements are examined and the 12.5% of the interior elements having the highest numerical values are left unchanged while all other interior elements are set to zero. If the number of channel vectors within lsftmp is greater than 6 (as indicated by lsfcount), then: i) the border elements are examined and the 20% of the border elements having the highest numerical values are left unchanged while all other border elements are set to zero; and ii) the interior elements are examined and the 10% of the interior elements having the highest numerical values are left unchanged while all other interior elements are set to zero. Then, all of the individual elements within the lsfttmp matrix are linearly quantized to signed 7-bit range (−64 . . . +63).

b) If the number of channel vectors within the restmp1 matrix (holding voiced channel vectors) is less than or equal to 6 (as indicated by count1), then: i) the border elements are examined and the 15% of the border elements having the highest numerical values are left unchanged while all other border elements are set to zero; and ii) the interior elements are examined and the 9% of the interior elements having the highest numerical values are left unchanged while all other interior elements are set to zero. If the number of channel vectors within restmp1 is greater than 6 (as indicated by count1), then: i) the border elements are examined and the 15% of the border elements having the highest numerical values are left unchanged while all other border elements are set to zero; and ii) the interior elements are examined and the 9% of the interior elements having the highest numerical values are left unchanged while all other interior elements are set to zero. Then, all of the individual elements within the restmp1 matrix are linearly quantized to signed 6-bit range (−32 . . . +31).

c) If the number of channel vectors within the restmp2 matrix holding unvoiced channel vectors) is less than or equal to 6 (as indicated by count2), then: i) the border elements are examined and the 25% of the border elements having the highest numerical values are left unchanged while all other border elements are set to zero; and ii) the interior elements are examined and the 15% of the interior elements having the highest numerical values are left unchanged while all other interior elements are set to zero. If the number of channel vectors within restmp2 is greater than 6 (as indicated by count2), then: i) the border elements are examined and the 12.5% of the border elements having the highest numerical values are left unchanged while all other border elements are set to zero; and ii) the interior elements are examined and the 10% of the interior elements having the highest numerical values are left unchanged while all other interior elements are set to zero. Then, all of the individual elements within the restmp2 matrix are linearly quantized to signed 6-bit range (−32 . . . +31).

In a preferred embodiment, the following operations are performed on the quantized lsftmp and restmp matrixes to arrange and compress their contents for transmission by Transmission Network 150. The operations preferably are not in-place operations, i.e., each input array is processed and the corresponding output is written to an output array. Then, the output array from the current stage of processing becomes the input array for the next stage of processing and the input array from the current stage of processing becomes the output array for the next stage of processing. Thus, as is known in the art, in a preferred embodiment only two temporary arrays for each matrix are needed. The processing stages in a preferred embodiment, in sequential order, are:

a) If count1 is less than 6, then restmp1 is considered to be a serial string of elements (read-out in raster order as is known in the art) and is output to the next stage. Otherwise, restmp1 is considered to be serial string of elements (read out in a zig-zag manner as is known in the art) and is output to the next stage. If count2 is less than 6, then restmp2 is considered to be a serial string of elements (read-out in raster order as is known in the art) and is output to the next stage. Otherwise, restmp2 is considered to be serial string of elements (read out in a zig-zag manner as is known in the art) and is output to the next stage. Array lsftmp is considered to be a serial string of elements (read-out in raster order as is known in the art) and is output to the next stage.

b) The outputs of the previous stage, now regarded as one-dimensional "strings" of bytes, undergo RLE (run-length encoding) which reduces the length of repeated byte runs. The lengths of each of the resulting byte strings, as well as the RLE-encoded byte strings themselves, are passed to the next stages so the appropriate number of bytes is operated upon.

c) Each of the RLE-encoded strings undergo a BWT (Burrows-Wheeler Transform), a recoverable, lossless block-sorting transformation that arranges the data in a manner more favorable for subsequent entropy coding. Each BWT operation returns an index value necessary for proper reconstruction of the array (and which must be transmitted to the receiver). The length of the RLE-encoded strings does not change; it is merely a rearrangement. The BWT indices are stored in a small array BWTidx[0 . . . 2].

d) The BWT-transformed strings undergo lossless MTF (Move-To-Front coding). This MTF stage maintains a symbol list; for each new item, the index of the item is buffered, and then that item is moved to the front of the list. The MTF is a recoverable, lossless transform. The MTF coder's state is reset prior to every use.

e) The MTF encoded strings are then again shortened with RLE encoding; the lengths of the resulting strings are retained to pass on to the next state.

f) The final step of residual and LSF compression is the arithmetic coding of each RLE-encoded string from e) above. The length of each arithmetically encoded string is saved in an array len[1 . . . 4]. p1 g) The class[0 . . . 119] array undergoes final arithmetic coding only. The length in bytes of this final arithmetically-encoded string is saved for transmission. This array undergoes lossless compression only.

h) A "data stream" as is know in the art is built for transmission over Transmission Network 150 to the decompression device, and represents the (compressed) contents of one speech frame for each of the supergroup's non-silent channels. Some additional header and error check information may be added with little overhead since it applies to a block of multiple channels. The following is an example data from with two transmitted categories V and UV.

[OPT 1 word] An optional header field byte/word for resynchronization ($FFFF) etc.

[1 word] Length, # bytes, to end of frame (for block Integrity check)

[1 word] Length, # bytes, of encoded/shrunk categorization table string;

[4 words] Lengths of categorization map string and encoded LSF, residual blocks after coding (len[ ])

[3 words] BWT indices for 3 data blocks: LSF, V, UV

[variable length] reduced/encoded channel categorization mapping string (class[ ])

[variable length] transformed/quantized/reduced/encoded LSF block

[variable length] transformed/quantized/reduced/encoded class#1 residual;

[variable length] transformed/quantized/reduced/encoded class#2 residual;

[OPT 1 word] checksum/CRC error detection/correction integrity.

Note, for example, that if all channels within a supergroup are silent, but the supergroup nevertheless contains active telephone connections, then this data frame will still be sent for the supergroup. In the case of this example, however, the LSF block, class #1 residual, and class #2 residual fields would all have lengths of zero.

Decompression System

The Decompression System is a preferred embodiment of the current invention, as depicted in FIG. 2. Data-streams that were produced by the Compression System described above are received by the Decompression System from Transmission Network 150. As described in connection with the Compression System above, each data-stream contains a speech frame for each channel of a single supergroup (which, in this embodiment, contains a maximum of 120 channels) and form a collection. As in the Compression System, data elements from a particular collection are processed completely independently from data elements from other collections.

Bitstream Input & Decoding

Bitstream input and decoding operations are performed by Decompression-side Preprocessor 210. Each data-stream is decoded and decompressed, and the result is used to populate the data structures that will be used in the subsequent resynthesis of source-identified-frames that contain speech. In this embodiment, data errors that may have occurred in the transmission of data-streams through Transmission Network 210 preferably are corrected by network error correction handlers as are known in the art. Decompression-side Preprocessor 210 decodes the channel categorization mapping string from a data-stream by applying arithmetic decoding operations to the channel categorization mapping string, as are known in the art. The decoded result is stored in class[120].

Decompression-side Preprocessor 210 decodes the LSF block, the class #1 residual, and the class #2 residual from a data-stream by reversing the operations performed on these items in the Compression System. The operations performed on each item, in sequence and as are known in the art, are arithmetic decoding, RLE decoding, MTF decoding, inverse BWrT and RLE decoding. The result of applying these operations to the LSF block is stored in lsftmp[ ][ ]. The applications of these operations to the class #1 (V) and class #2 (UV) residuals results in a class #1 matrix of data elements and a class #2 matrix of data elements.

The number of rows in the class #1 matrix of data elements is equal to the number of channel vectors stored in the matrix. As described in the Compression System, the restmp1 array (which ultimately produced the class #1 residual matrix) was read out in a zig-zag manner if it contained 6 or more channel vectors, otherwise, the array was read out in a normal raster manner. Thus, if the class #1 matrix of data elements contains less than 6 rows, then it is stored directly in rtmp1[ ][ ] as is known in the art, otherwise, if the class #1 matrix of data elements contains 6 or more rows, then a reverse zig-zag operation is applied to the class #1 matrix of data elements and the result is stored in rtmp1[ ][ ]. The class #2 matrix of data elements is processed in a manner similar to that of the class #1 matrix of data elements, and the result is stored in rtmp2[ ][ ].

In a manner similar to the operations performed in the Compression System, the operations performed on the LSF block, the class #1 residual, and the class #2 residual are not performed in-place. Rather, each input array is processed and the corresponding output is written to an output array. Then, the output array from the current stage of processing is used as the input array for the next stage of processing, and the input array from the current stage of processing is used as the output array for the next stage of processing. Thus, by swapping array functions as is known in the art, only two temporary arrays for processing each matrix are required.

The resulting arrays lsftmp[ ][ ], rtmp1[ ][ ], and rtmp2[ ][ ] have proper two-dimensional orientation and arrangement for the inverse dyadic wavelet transforms, but are quantized. As is known in the art, the data elements in each of these resulting arrays are dequantized, i.e., the data elements are scaled to their original ranges, and the dequantized data elements from lsftmp[ ][ ], rtmp1[ ][ ], and rtmp2[ ][ ] are stored in lsf[ ][ ], resid1[ ][ ], and resid2[ ][ ]. In the terminology used in this Specification, lsf[ ][ ], resid1 [ ][ ], and resid2[ ][ ] are each a transformed-frame-block. These transformed-frame-blocks are made available to First-Inverse-Transformer 220 by Decompression-side Preprocessor 210 for further processing.

Two-Dimensional Inverse Transformation

The transformed-frame-blocks, lsf[ ][ ], resid1[ ][ ], and resid2[ ][ ], are received by First Inverse-Transformer 220, and are processed by the inverse of the two-dimensional transformation applied in the Compression System. In this example, a three level dyadic two-dimensional Daubechies "D4" inverse wavelet transform is used, as is known in the art. This inverse transformation is applied to each array lsf[ ][ ], resid1[ ][ ], and resid2[ ][ ] in-place. The result of this processing is the transformation of the transformed-frame-blocks held in arrays lsf[ ][ ], resid1[ ][ ], and resid2[ ][ ] to frame-blocks held in arrays lsf[ ][ ], resid1[ ][ ], and resid2[ ][ ]. These frame-blocks are made available by First Inverse-Transformer 220 to Assembler 230 for further processing.

Assembly

The frame-blocks held in arrays lsf[ ][ ], resid1[ ][ ], and resid2[ ][ ] are received by Assembler 230. As is known in the art, the category map stored in class, the knowledge that there are no silent frame residuals or LSFs in the frame-blocks, and the knowledge that array lsf[ ][ ] is populated in the same order as the ungrouped residual arrays, permits the assembly of LSF transformed-source-identified-frames (taken from the frame-block held in array lsf[ ][ ]) with the associated residual transformed-source-identified-frames (taken from the frame-blocks held in arrays resid1[ ][ ] and resid2[ ][ ]). This process is described in more detail in the pseudocode fragment provided below in the "LPC Resynthesis" subsection below. The assembled LSF transformed-source-identified-frames are made available by Assembler 230 to Second Inverse-Transformer 240 for further processing.

LPC Resynthesis

The assembled LSF transformed-source-identified-frames are received by Second Inverse-Transformer 240. These transformed-source-identified-frames continue to be stored in arrays lsf[ ][ ], resid1[ ][ ], and resid2[ ][ ]. The inverse of the LPC transformation applied in the compression system is applied to the assembled transformed-source-identified-frames, and the resulting source-identified-frames are stored in output[0 . . . 119][ ]. Each source-identified-frame is stored in the row of output whose index corresponds with the channel from which the source-identified-frame was derived in the Compression System.

The following pseudocode fragment describes the assembly of LSF transformed-source-identified-frames and associated residual transformed-source-identified-frames, LPC resynthesis, and the population of the array output:

```
.
.
.
lsfcount = count1 = count2 = 0;                    // reset counters . . .
for channel = 0 to < num_active_channels-1 {       // for each active channel
    if(class[channel] ≠ SILENT) {                  // if not silent,
        copy_vector( (lsf[lsfcount][]
            + avg_LSF[]) → lsftmp[channel][]);     // . . . copy its lsf vector to lsf
                                                   work buffer
        lsfcount = lsfcount + 1;                   // . . . increment index counter
        switch(class[channel]) {                   // Determine residual type
        case VOICED:                               // if voiced
            copy_vector( resid1[count1][]
                → residual[channel][]);            // . . . put in work buffer
            count1 = count1 + 1;                   // . . . inc. voiced-resid index
                                                   counter
        case UNVOICED:                             // similar to voiced
            copy_vector( resid2[count2][]
                → residual[channel][]);
            count2 = count2 + 1;
        }//end_switch
    else {                                         // silent, so zero LSFs &
                                                   residuals
        fill_with_zeros( lsftmp[channel][]);
        fill_with_zeros( residual[channel][]);
        }
    } // end_for
.
.
.
for channel = 0 to num_active_channels {           // LPC resynthesis
    output[channel][] =     LPC_inverse_transformation( lsftmp[channel][],
                                                   prev_LSF[channel][],
                                                   syn_filt_hist[channel][],
                                                   residual[channel][]
                                                   );
    }
.
.
.
```

It should be noted that the previous LSF transformed-source-identified-frame for each channel is stored. The stored frame for a particular channel is set to zero when a new channel connection is established for that channel or when a silent frame for that channel is received. A channel's previous LSF frame is combined with the current LSF frame to form a weighted LSF vector. This is performed in the same manner as in the LPC analysis filtering performed in the Compression System, with the same old/new weighting ratio and by changing four times per frame, i.e., every 5 milliseconds per 40 samples. A synthesis filter-history buffer, syn_filt_hist[0 . . . 119][0 . . . 101], is maintained; this buffer carries the filter state from call to call for a given channel, and is similar to the analysis filter state history buffer filtmem[ ][ ] described in the LPC Residual Generation section above.

The source-identified-frames, held in output[ ][ ], are made available by Second Inverse-Transformer 240 to Decompression-side Postprocessor 250. As is known in the art, in a preferred embodiment, a deemphasis operation is performed on each source-identified-frame held in output. This deemphasis is the exact inverse of the preemphasis filtering operation performed in the Compression System. A one-dimensional deemphasis filter state buffer, deemph_sav[0 . . . 119] holds the deemphasis filter states between calls for each channel, similar in operation to the counterpart preemphasis operation in the Compression System.

Following the deemphasis operation, the source-identified-frames in output are converted, as is known in the art, to the $\mu$-Law or A-Law encoding required for Data Channels 270. Finally, Decompression-side Postprocessor 250 outputs the source-identified-frames to Data Channels 270 through telephone line interface equipment, as is known in the art.

It will be apparent to those skilled in the art that various modifications can be made to this invention of a system and method for processing data from multiple channels and of a system and method for processing data for multiple channels, without departing from the scope or spirit of the invention or of the claims. It is also intended that the present invention and appended claims cover modifications, variations, and equivalents of the system and method for processing data from multiple channels of the present invention and of the system and method for processing data for multiple channels of the present invention.

I claim:

1. A system for processing data from multiple channels, comprising:

a first transformer having means for receiving a plurality of source-identified-frames, and means for transforming at least one source-identified-frame into at least one transformed-source-identified-frame;

a classifier, in communication with the first transformer, having means for receiving at least one transformed-source-identified-frame from the first transformer, means for categorizing at least one transformed-source-identified-frame by domain type wherein there is at least one prespecified domain type, means for categorizing at least one transformed-source-identified-frame by category type wherein there is at least one prespecified category type, means, responsive to the domain type and the category type of at least one transformed-source-identified-frame, for grouping at least one transformed-source-identified-frame into at least one frame-block;

a second transformer, in communication with the classifier, having means for receiving at least one frame-block from the classifier, and means for transforming at least one frame-block into at least one transformed-frame-block; and a postprocessor, in communication with the second transformer and a transmission network, having means for receiving at least one transformed-frame-block from the second transformer, means for compressing at least one transformed-frame-block into at least one data-stream, and means for transmitting at least one data-stream to the transmission network.

2. The system for processing data from multiple channels of claim 1, wherein the source-identified-frames comprise speech-type data, and the transforming means of the first transformer comprises means for converting at least one source-identified-frame into at least one transformed-source-identified-frame having a first domain type related to vocal-tract parameters and at least one transformed-source-identified-frame having a second domain type related to residual excitation signals.

3. The system for processing data from multiple channels of claim 2, wherein at least one transformed-source-identified-frame having the first domain type related to vocal-tract parameters comprises a line spectra including at least one line-spectra-value.

4. The system for processing data from multiple channels of claim 3 wherein the grouping means of the classifier comprises means for arranging the transformed-source-identified-frames grouped into at least one frame-block.

5. The system for processing data from multiple channels of claim 4 wherein the arranging means comprises means for averaging the line-spectra-values of each transformed-source-identified-frame that comprises line spectra and that is grouped into at least one frame-block, and wherein the arranging means is responsive to the averaging means.

6. The system for processing data from multiple channels of claim 4 wherein the arranging means comprises means for selecting, in accordance with predefined criteria, a subset of the line-spectra-values of each transformed-source-identified-frame that comprises line spectra and that is grouped into at least one frame-block, and means for averaging the subset of the line-spectra-values; and wherein the arranging means is responsive to the averaging means.

7. The system for processing data from multiple channels of claim 4 wherein the arranging means comprises means for associating an average-frame-energy with each transformed-source-identified-frame that is grouped into at least one frame-block; and wherein the arranging means is responsive to the average-frame-energy associating means.

8. The system for processing data from multiple channels of claim 7 wherein the average-frame-energy associating means is responsive to an average-frame-energy of each transformed-source-identified-frame having a second domain type related to residual excitation signals and that is grouped into at least one frame-block.

9. The system for processing data from multiple channels of claim 4 wherein the arranging means comprises means for associating an average-frame-energy with each source-identified-frame and wherein the arranging means is responsive to the average-frame-energy associating means.

10. The system for processing data from multiple channels of claim 4 wherein the arranging means comprises means for associating a zero-crossing-rate with each transformed-source-identified-frame having a second domain type related to residual excitation signals and that is grouped into at least one frame-block; and wherein the arranging means is responsive to the zero-crossing-rate associating means.

11. The system for processing data from multiple channels of claim 4 wherein the arranging means comprises means for associating a zero-crossing-rate with each source-identified-frame and wherein the arranging means is responsive to the zero-crossing-rate associating means.

12. The system for processing data from multiple channels of claim 2, wherein at least one category type relates to fully-silent-type transformed-source-identified-frames, at least one category type relates to voiced-type transformed-source-identified-frames, and at least one category type relates to unvoiced-type transformed-source-identified-frames.

13. The system for processing data from multiple channels of claim 1, wherein the transforming means of the second transformer comprises a forward two-dimensional transform.

14. The system for processing data from multiple channels of claim 13, wherein the forward two-dimensional transform comprises a transform selected from the group consisting of a Fourier transform, a Fast Fourier transform, a wavelet transform, a DST transform, a DCT transform, a Haar transform, a Walsh transform, and a KLT transform.

15. The system for processing data from multiple channels of claim 1, wherein the compressing means of the postprocessor comprises means for converting at least one transformed-frame-block to a differential representation.

16. The system for processing data from multiple channels of claim 1, further comprising a preprocessor, in communication with the first transformer, having means for receiving a plurality of data channels, and means for segmenting at least one data channel into a plurality of source-identified-frames.

17. A system for processing data for multiple channels, comprising:

a preprocessor, in communication with a transmission network, having means for receiving at least one data-stream from the transmission network, and means for decompressing at least one data-stream into at least one transformed-frame-block;

a first inverse-transformer, in communication with the preprocessor, having means for receiving at least one transformed-frame-block from the preprocessor, and means for inverse-transforming at least one transformed-frame-block into at least one frame-block;

an assembler, in communication with the first inverse-transformer, having means for receiving at least one frame-block from the first inverse-transformer, and means for separating at least one frame-block into at least one transformed-source-identified-frame; and a second inverse-transformer, in communication with the assembler, and having means for receiving at least one transformed-source-identified-frame from the assembler, and means for inverse-transforming at least one transformed-source-identifed-frame into at least one source-identified-frame.

18. The system for processing data for multiple channels of claim 17, wherein the inverse-transforming means of the first inverse-transformer comprises an inverse two-dimensional transform.

19. The system for processing data for multiple channels of claim 18, wherein the inverse two-dimensional transform comprises a transform that is selected from the group consisting of a Fourier transform, a Fast Fourier transform, a wavelet transform, a DST transform, a DCT transform, a Haar transform, a Walsh transform, and a KLT transform.

20. The system for processing data for multiple channels of claim 17, wherein the inverse-transforming means of the second inverse-transformer comprises an inverse LPC transform.

21. The system for processing data for multiple channels of claim 17, further comprising a postprocessor, in communications with the second inverse-transformer, having means for receiving at least one source-identified-frame, and means, responsive to at least one source-identified-frame, for combining at least one source-identified-frame into at least one data channel.

22. A method for processing data from multiple channels, comprising the steps of:

receiving a plurality of source-identified-frames;

transforming at least one source-identified-frame into at least one transformed-source-identified-frame;

categorizing at least one transformed-source-identified-frame by domain type wherein there is at least one prespecified domain type;

categorizing at least one transformed-source-identified-frame by category type wherein there is at least one prespecified category type;

grouping, responsive to the domain type and the category type of at least one transformed-source-identified-frame, at least one transformed-source-identified-frame into at least one frame-block;

transforming at least one frame-block into at least one transformed-frame-block;

compressing at least one transformed-frame-block into at least one data-stream; and transmitting at least one data-stream to a transmission network.

23. The method of processing data from multiple channels of claim 22, wherein the source-identified-frames comprise speech-type data, and the source-identified-frame transforming step comprises the step of converting at least one source-identified-frame into at least one transformed-source-identified-frame having a first domain type related to vocal-tract parameters and at least one transformed-source-identified-frame having a second domain type related to residual excitation signals.

24. The method of processing data from multiple channels of claim 23, wherein at least one transformed-source-identified-frame having the first domain type related to vocal-tract parameters comprises a line spectra including at least one line-spectra-value.

25. The method of processing data from multiple channels of claim 24, wherein the grouping step comprises the step of arranging the transformed-source-identified-frames grouped into at least one frame-block.

26. The method of processing data from multiple channels of claim 25, wherein the arranging step comprises the step of averaging the line-spectra-values of each transformed-source-identified-frame that comprises line spectra and that is grouped into at least one frame-block, and wherein the arranging step is responsive to the averaging step.

27. The method of processing data from multiple channels of claim 25 wherein the arranging step comprises the step of selecting, in accordance with predefined criteria, a subset of the line-spectra-values of each transformed-source-identified-frame that comprises line spectra and that is grouped into at least one frame-block, and the step of averaging the subset of the line-spectra-values; and wherein the arranging step is responsive to the averaging step.

28. The method of processing data from multiple channels of claim 25 wherein the arranging step comprises the step of associating an average-frame-energy with each transformed-source-identified-frame that is grouped into at least one frame-block; and wherein the arranging step is responsive to the average-frame-energy associating step.

29. The method of processing data from multiple channels of claim 28 wherein the average-frame-energy associating step is responsive to an average-frame-energy of each transformed-source-identified-frame having a second domain type related to residual excitation signals and that is grouped into at least one frame-block.

30. The method of processing data from multiple channels of claim 25 wherein the arranging step comprises the step of associating an average-frame-energy with each source-identified-frame and wherein the arranging step is responsive to the average-frame-energy associating step.

31. The method of processing data from multiple channels of claim 25 wherein the arranging step comprises the step of associating an zero-crossing-rate with each transformed-source-identified-frame having a second domain type related to residual excitation signals and that is grouped into at least one frame-block; and wherein the arranging step is responsive to the zero-crossing-rate associating step.

32. The method of processing data from multiple channels of claim 25 wherein the arranging step comprises the step of associating a zero-crossing-rate with each source-identified-frame and wherein the arranging step is responsive to the zero-crossing-rate associating step.

33. The method of processing data from multiple channels of claim 23, wherein at least one category type relates to fully-silent-type transformed-source-identified-frames, at least one category type relates to voiced-type transformed-source-identified-frames, and at least one category type relates to unvoiced-type transformed-source-identified-frames.

34. The method of processing data from multiple channels of claim 22, wherein the frame-block transforming step comprises a forward two-dimensional transform.

35. The method of processing data from multiple channels of claim 34, wherein the forward two-dimensional transform comprises a transform selected from the group consisting of a Fourier transform, a Fast Fourier transform, a wavelet transform, a DST transform, a DCT transform, a Haar transform, a Walsh transform, and a KLT transform.

36. The method of processing data from multiple channels of claim 22, wherein the step of compressing at least one transformed-frame-block comprises the step of converting at least one transformed-frame-block to a differential representation.

37. The method of processing data from multiple channels of claim 22, further comprising the steps of receiving a plurality of data channels;

segmenting at least one data channel into a plurality of source-identified-frames; and transmitting the plurality of source-identified-frames.

38. A method of processing data for multiple channels, comprising the steps of:

receiving at least one data-stream from a transmission network;

decompressing at least one data-stream into at least one transformed-frame-block;

inverse-transforming at least one transformed-frame-block into at least one frame-block;

separating at least one frame-block into at least one transformed-source-identified-frame; and inverse-transforming at least one transformed-source-identified-frame into at least one source-identified-frame.

39. The method of processing data for multiple channels of claim 38, wherein the transformed-frame-block inverse-transforming step comprises an inverse two-dimensional transform.

40. The method of processing data for multiple channels of claim 39, wherein the inverse two-dimensional transform comprises a transform that is selected from the group consisting of a Fourier transform, a Fast Fourier transform, a wavelet transform, a DST transform, a DCT transform, a Haar transform, a Walsh transform, and a KLT transform.

41. The method of processing data for multiple channels of claim 38, wherein the transformed-source-identified-frame inverse-transforming step comprises an inverse LPC transform.

42. The method of processing data for multiple channels of claim 38, further comprising the step of combining, responsive to at least one source-identified-frame, at least one source-identified-frame into at least one data channel.

* * * * *